US006516923B2

(12) United States Patent
Lence Barreiro et al.

(10) Patent No.: US 6,516,923 B2
(45) Date of Patent: Feb. 11, 2003

(54) ELEVATOR AUDITING AND MAINTENANCE

(75) Inventors: Juan A. Lence Barreiro, Santiago de Compostela (ES); Chouhwan Moon, Glastonbury, CT (US)

(73) Assignee: Otis Elevator Company, Farmington, CT (US)

( * ) Notice: Subject to any disclaimer, the term of this patent is extended or adjusted under 35 U.S.C. 154(b) by 22 days.

(21) Appl. No.: 09/898,853

(22) Filed: Jul. 2, 2001

(65) Prior Publication Data

US 2003/0000777 A1 Jan. 2, 2003

(51) Int. Cl.[7] ..... B66B 3/00
(52) U.S. Cl. ..... 187/391; 187/316; 187/247
(58) Field of Search ..... 187/291, 247, 187/284, 316, 317, 391, 393, 398, 399

(56) References Cited

U.S. PATENT DOCUMENTS 3,973,648 A * 8/1976 Hummert et al. ..... 187/393
4,512,442 A * 4/1985 Moore et al. ..... 187/393
4,750,591 A * 6/1988 Coste et al. ..... 187/391
4,930,604 A * 6/1990 Schienda et al. ..... 187/393
5,557,546 A * 9/1996 Fukai et al. ..... 187/391
5,760,350 A * 6/1998 Pepin et al. ..... 187/316
6,330,935 B1 * 12/2001 Systermans ..... 187/391
6,330,936 B1 * 12/2001 Lence Barreiro et al. ... 187/247

* cited by examiner

*Primary Examiner*—Jonathan Salata

(57) ABSTRACT

Information including normal and abnormal operating conditions and events, occurring during the operation of an elevator car door and landing doors, is monitored and recorded (FIGS. 1–25), compared and combined with other information and with thresholds to detect notable events and conditions and generate corresponding maintenance recommendation messages, in response to which maintenance operations are performed. The maintenance messages include adjusting or cleaning: the car door vane (C), the landing door lock at a given floor (D, E), the car door closed switch (F), the car door track or the car door sill (M), a landing door track or landing door sill (N), the car door drive belt (O), the elevator car door motor or the related door controller mechanism (R), and car guide rails (YY); adjusting or replacing the door position encoder (DD), the between-door safety device (GG), door open and close buttons, landing call and car call buttons (LL) and lights (SS), and the car rail guides (WW).

10 Claims, 22 Drawing Sheets

ELEVATOR AUDITING AND MAINTENANCE

RELATED APPLICATIONS

Some matter disclosed herein is disclosed and claimed in commonly owned copending U.S. patent application Ser. No. 09/899,007 filed contemporaneously herewith.

1. Technical Field

This invention relates to auditing events and conditions relating to the operation of elevator car doors and landing doors to provide maintenance messages indicative of maintenance action which is recommended to be taken, and maintaining the elevator in response to the maintenance messages.

2. Background Art

Elevator service known to the art depends primarily on periodic inspections and periodic performance of preventive actions, such as rebuilding subsystems, changing parts that are known to wear out, and the like. However, the periods of time between such inspections and preventive actions is based on average elevator environment, average elevator usage and average elevator maintenance. Therefore, the selected time period bears little relevance to the actual conditions of any particular elevator. In addition, periodic inspections rarely detect existing or impending problems. Periodic preventive actions are wasteful when unnecessary.

Prior elevator maintenance and repair has heretofore been based on very little information, depending instead on the intuition of service personnel which in turn depends substantially on the experience level of the service personnel. Service personnel must first determine the likely source of a problem and then make a subjective decision about what, if any, action is to be taken.

In the prior art, there is little if any assistance in detecting intermittent problems. When a problem has occurred but the elevator is running on arrival of the service personnel, the problem will not then be apparent to the service personnel. Maintenance recommendation messages provided by prior art maintenance systems have typically been very general, such as "problem closing door" or "problem opening door".

DISCLOSURE OF INVENTION

Objects of the invention include: providing elevator door service and maintenance based upon factual information, including both performance and failure information, relative to the landing and car doors of a specific elevator; reducing reliance on periodic inspection and periodic preventive action for elevator door-related maintenance; providing necessary elevator door-related maintenance while reducing unnecessary maintenance activities; eliminating reliance on subjective intuition of service personnel in maintaining and servicing elevator doors; reducing reliance on experience of service personnel in maintaining and servicing elevator doors; finding the origin of elevator door problems quickly; restoring elevator service faster after having door problems; detecting the cause of intermittent elevator door problems; providing information allowing the identification of obscure elevator door problems; and permitting corrective action to be taken even when the elevator is running on arrival of service personnel.

According to the present invention, performance and failure information relative to the landing and car doors of an elevator is extracted, stored and analyzed to provide sets of recommended maintenance actions and problem resolution service actions.

(A) According to the present invention, operating speeds, operating times, positions, events, discrete conditions, durations, and numbers of occurrences are monitored and stored, and the information is logically combined, accumulated, averaged compared against specific corresponding threshold values, and so forth, to determine when notable events have occurred and to identify the nature thereof, which then determines maintenance messages identifying recommended maintenance and/or service actions which should be taken.

(B) The invention includes performance of a maintenance operation on the elevator system in response to any such maintenance messages, which include:

(C) adjusting the position of the car door vane;

(D) adjusting the position of the landing door lock at a given floor;

(E) adjusting or cleaning the landing door lock at a given floor;

(F)–(L) adjusting the car door closed switch;

(M) adjusting or cleaning the car door track or the car door sill;

(N) adjusting or cleaning the landing door track or landing door sill at a given landing;

(O)–(Q) adjusting a flexible traction loop (the door drive belt);

(R)–(CC) adjusting the elevator car door motor or the related door controller mechanism;

(DD)–(FF) adjusting or replacing the door position encoder;

(GG)–(KK) adjusting or replacing the between-door safety device;

(LL)–(RR) adjusting or replacing door open and/or close buttons, and landing call and car call buttons;

(SS)–(VV) replacing landing call button lights and car call button lights;

(XX) adjusting or replacing the car rail guides; and (YY) adjusting the side-to-side clearance of the car guide rails at a given landing.

The invention provides an electronic elevator door-related maintenance record that shows the level of maintenance quality. The invention enables establishing relevant elevator door-related maintenance programs based on actual conditions of each elevator.

Other objects, features and advantages of the present invention will become more apparent in the light of the following detailed description of exemplary embodiments thereof, as illustrated in the accompanying drawing.

BRIEF DESCRIPTION OF THE DRAWINGS

FIG. 1—speeds and positions relating to the door lock switch and the door lock switch being bypassed;

FIG. 2—the door lock switch failing, being opened or closed, and being open without a command;

FIG. 3—speed relating to the landing door lock closure, and landing door lock rebounds;

FIG. 4—positions relating to the car door closed switch, and the car door closed switch being bypassed;

FIG. 5—the car door closed switch being closed, failing, and open without a command, and a car switch problem position;

FIG. 6 a continuation of the car door closed switch being closed, failing, and open without a command, and a car switch problem position;

FIG. 7—door opening time and mode;

FIG. 8—door closing time and mode;

FIG. 9—opening and closing retrocession distance and door state;

FIG. 10—pulse widths, opening pulse number and car door position error; and

FIGS. 11–12—opening obstacles, severity and position.

FIG. 14—closing obstacles, severity and position;

FIG. 15—car door open and closed position and opening and closing speeds;

FIG. 16—passengers interacting with the door being likely or unlikely;

FIG. 17—operation and duration of a door safety device;

FIG. 18—operation and duration of a door open button;

FIG. 19—operation and duration of a door close button;

FIG. 20—operation and duration of hall call buttons;

FIG. 21—operation and duration of car call buttons;

FIG. 22—operation and duration of hall call lights;

FIG. 23—operation and duration of car call lights;

FIG. 24—door reversals; and

FIG. 25—total distance traveled by the car.

MODE(S) FOR CARRYING OUT THE INVENTION

Figure 26:
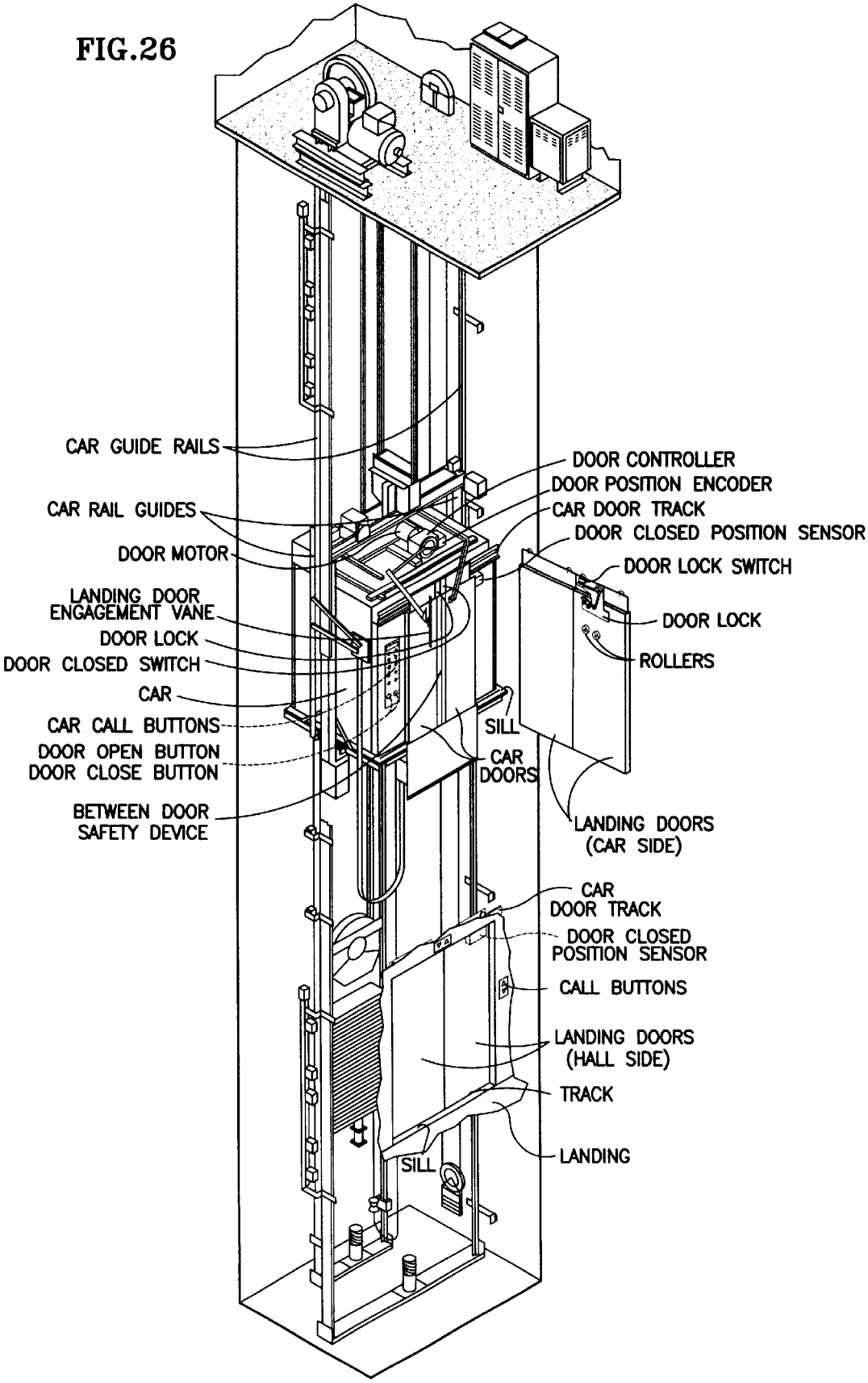
FIG. 26 is a perspective view, partially broken away, of a conventional elevator system with which the present invention may be practiced.

In FIG. 26, a conventional elevator system having a plurality of landings, only one of which is shown, includes car guide rails between which the car is juxtaposed by car rail guides. The car has doors operated by a door controller on car door tracks above a sill. The door has a door lock, a door close switch and a door close position sensor. The car door has a landing door engagement vane and the landing doors have rollers so that the car door can open and close the landing doors. In the car, there are car call buttons and door open and door close buttons. Between the car doors, there is a between door safety device.

The landing doors have a door lock switch, a door close position sensor, and are guided by car door tracks above a sill. At each landing, there are landing call buttons which have lights, as is known.

Figure 1:
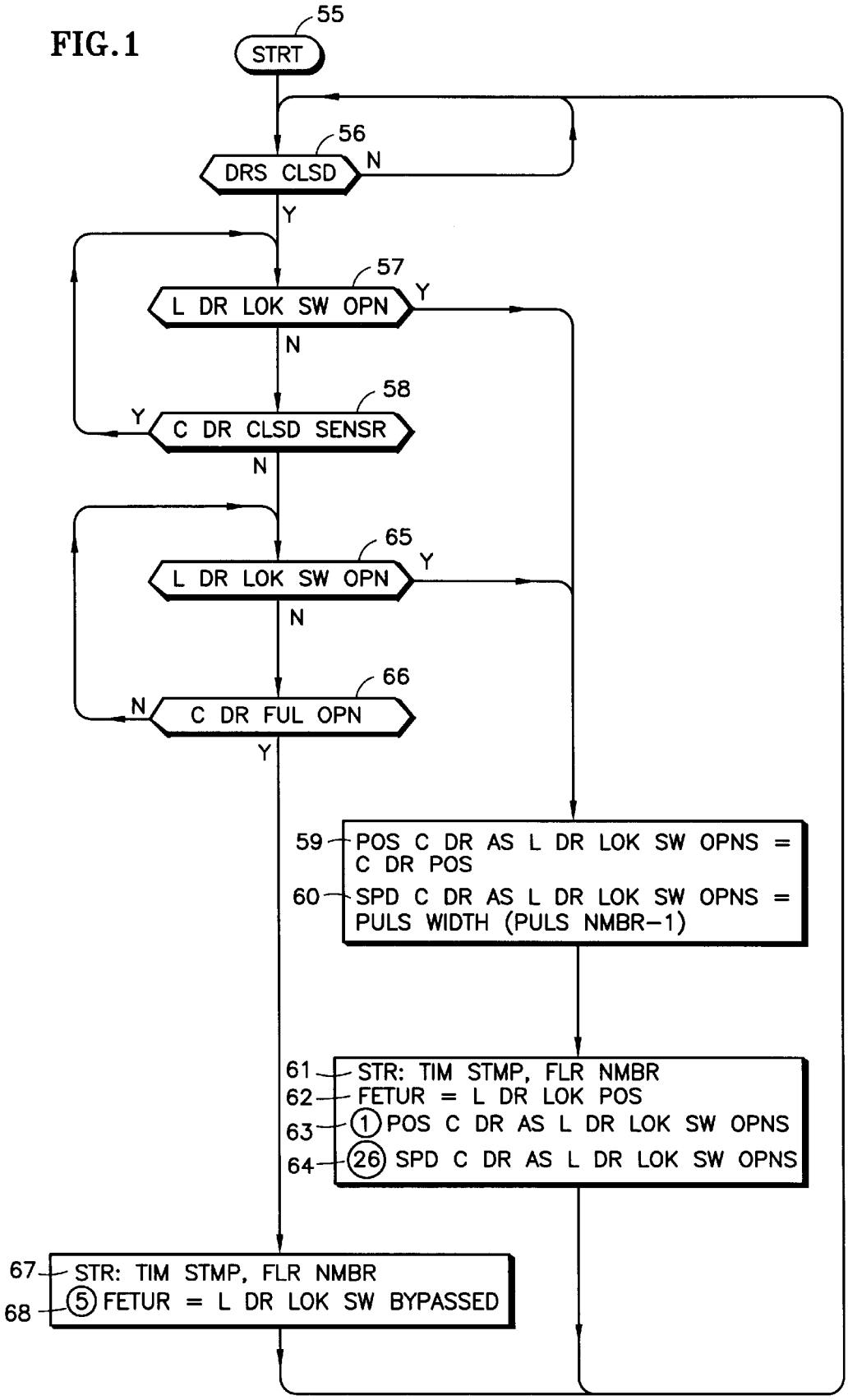
FIGS. 1–12 are logic flow diagrams of routines related to various parameters and features as follows.

Referring to FIG. 1, a routine that generates information about the landing door lock switch is reached through a start entry point 55 and the program waits at a first test 56 until the car door and the landing door are both closed; then a test 57 determines if the landing door lock switch is open. With the door closed, the landing door lock switch will initially not be open, so a test 58 determines if the car door closed sensor is operated. The routine will cycle between tests 57 and 58 until either the landing door lock switch opens or the car door closed sensor no longer senses that the car door is closed. If the landing door lock switch opens first, an affirmative result of test 57 leads to a step 59 where the position of the car door as the landing door lock switch opens is set equal to the car door position, which is provided by a car door position sensor of a conventional type. In a step 60, the speed of the car door as the landing door lock switch opens is set equal to the pulse width of the pulse from the door position encoder which is one pulse ahead of the current pulse. Then a pair of steps 61, 62 store the time stamp (present real time) and floor number (where the car is at this instant), and the feature, which is a way of identifying an event or occurrence of a particular nature; in this case the feature is referred to as "landing door lock position". In the embodiment described herein, a "feature" may be an actual parameter used in the method of auditing and method of maintenance of the invention, or it may simply be the signaling of the event which may be used in processing to achieve the methods of the invention. In this case, the feature, landing door lock position, may be used as an indication that parameters 1 and 26 should be examined. In the drawing, parameter numbers are provided within circles. Some parameters, such as Parameter No. 11, the number of car door operations, are obtained in a trivial fashion and therefore are not shown or described. Then step 63 stores Parameter No. 1, the position of the car door as the landing door lock switch opens, and step 64 stores Parameter No. 26, the speed of the car door as the landing door lock switch opens.

If in test 58, the car door closed position sensor no longer senses that the car door is closed, before test 57 determines that the landing door lock switch is open, a test 65 determines if the landing door lock switch is open; initially it will not be so a test 66 determines if the car door is fully open. Initially the car door will not be fully open, so a negative result of test 66 will cause the routine to loop through test 65 and test 66 until either the landing door lock switch is fully open, which is the usual case, or the car door becomes fully open without the landing door lock switch opening, which is a remarkable event. If the landing door lock switch opens, the steps 59–64 are performed as described hereinbefore. But if the car door becomes fully open while the landing door lock switch is not open, an affirmative result of test 66 reaches steps 67 and 68 to store the time stamp and floor number and to store Parameter No. 5, a feature called "landing door lock switch bypassed". This feature indicates either that the switch is jammed in a closed position, or that a technician may have placed jumper leads across the switch, or that the switch may appear to be closed due to conductivity of dust or other debris. In this case the feature is an event which is also a parameter. Note that some parameters are expressed differently in the text from the expression in the drawing: Parameter No. 5 is also referred to as "the landing door lock switch being closed when the landing door is open". However, identity is established through the parameter numbers.

Figure 2:
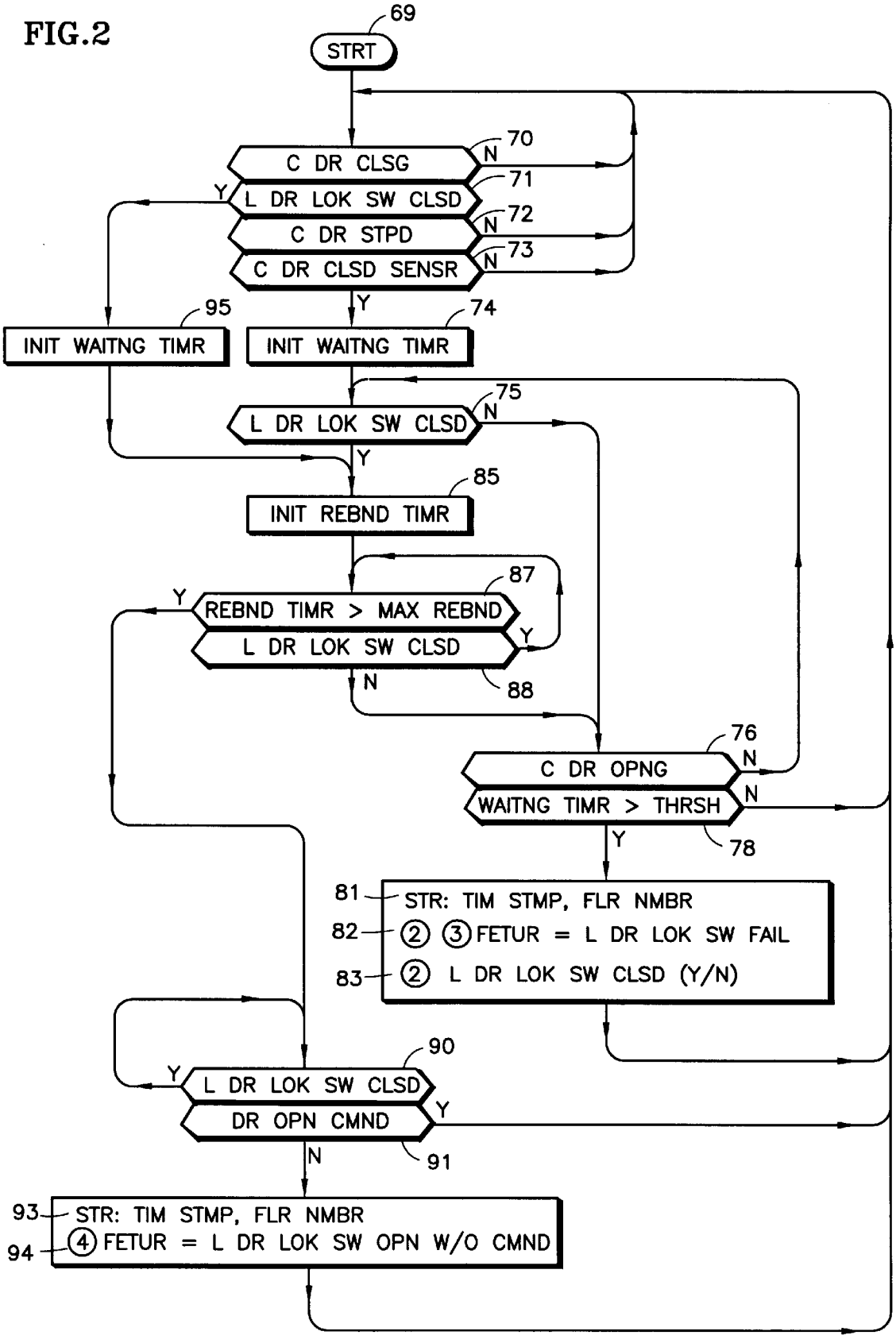

In FIG. 2, another routine relating to the landing door lock switch is reached through a start entry point 69 and the routine waits at a first test 70 until the car door begins to close. Then a test 71 determines if the landing door lock switch is closed. Initially, it will not be so a test 72 will determine if the car door has stopped, and the routine will cycle through steps 70, 71 and 72 until the car door is stopped. When the car door stops, a test 73 determines if the car door closed sensor has actuated, and if not, the routine will cycle through the tests 70–73 until the car door close sensor is actuated by the car door becoming closed. When the car door is closed, a waiting timer is initiated in a step 74 and a test 75 determines if the landing door lock switch is closed; assume for now that it is not, then a test 76 will determine if the car door is opening. With the car door closed sensor just having been actuated, test 76 will usually be initially negative cycling back through test 75 until either the door lock switch becomes closed or the car door begins to open. If the car door begins to open, then a test 78 determines if the waiting timer, which was initiated in step 74, has advanced past a threshold or not. If not, it probably means that the landing door lock switch did not close because the car door began to open as soon as it was closed. Thus, a negative result of test 78 causes the routine to revert to the test 70. But after the waiting timer exceeds a threshold amount of time, which may be on the order of two or three seconds, an affirmative result of test 78 will reach a series of steps 81–83 which store the time stamp and floor number, the feature "landing door lock switch failure" which is a combination of Parameter No. 2, the landing door lock switch not closing and Parameter No. 3, landing door lock switch closed (indicating yes or no, as to whether it is or not). Then the program reverts to step 70 as described hereinbefore.

If the landing door lock switch had closed as soon as the car door closed sensor had been activated, then an affirmative result of test 75 would have reached a step 85 to initiate a rebound timer. Then a test 87 determines if the rebound timer has exceeded a maximum rebound time limit, or not. Initially it will not, so a negative result of test 87 reaches a test 88 to determine if the landing door lock switch is closed or not. If it remains closed, then the routine loops between tests 87 and 88 until the rebound timer times out. But, if the door switch does not remain closed before the rebound timer times out, then a negative result of test 88 will reach test 76, and the routine will proceed as described hereinbefore. On the other hand, if the switch remains closed until after the rebound timer times out, that means that the switch did not rebound into the open state, and an affirmative result of test 87 will reach a test 90 to see if the landing door lock switch remains closed. In the usual case, it will until the landing door reopens. When the test 90 indicates that the landing door lock switch is no longer closed, then a test 91 determines if there has been a door open command; if there has, this indicates normal operation and the routine reverts to test 70 to await the door closing once again. On the other hand, if the door lock switch does not remain closed and there is no door open command, then a negative result of test 91 reaches a pair of steps 93, 94 to store the time stamp and floor number and to store Parameter No. 4, the feature called landing door lock switch open without command. Assume that the routine reaches tests 76 and 78 and the waiting timer has not timed out. A negative result of test 78 will return the routine to test 70, and if the car door is closing, will reach tests 71–73, depending on conditions. If test 71 is positive, then a step 95 will initiate the waiting timer and all of the other tests and steps 72–75 are bypassed. The routine is thereafter as described hereinbefore, beginning with step 85 which initiates the rebound timer.

Figure 3:
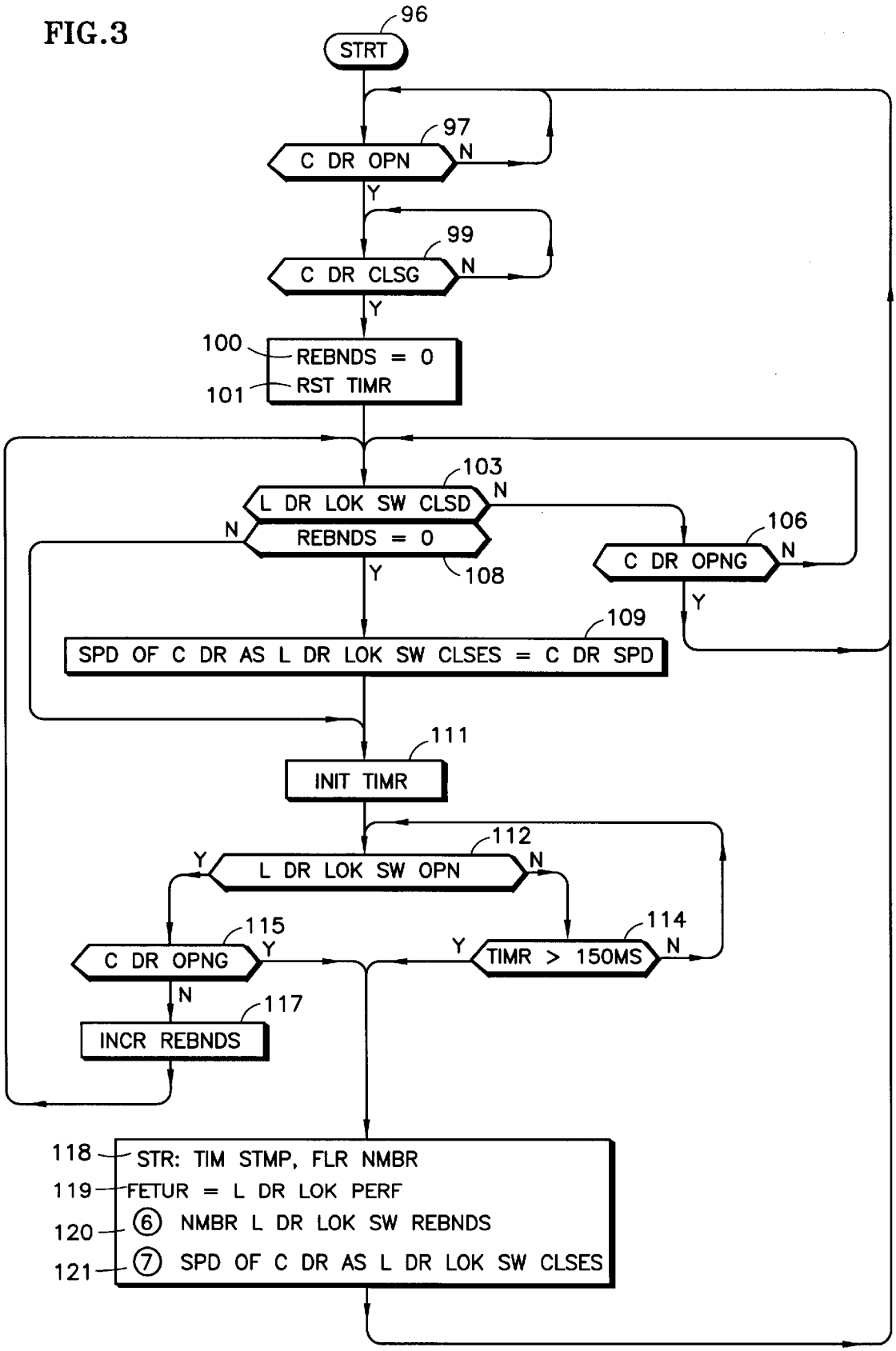

In FIG. 3, a routine which monitors door lock switch rebounds and speed as the door lock closes, is reached through a start entry point 96 and the routine will wait at a test 97 until the car door is open. Then the routine will wait at a test 99 until the car door is closing, after which a step 100 sets a rebound counter equal to zero and a step 101 resets a timer used in this routine. Then a test 103 determines if the landing door lock switch is closed; if not, a test 106 determines if the car door is opening; if neither is happening, the routine waits, looping through tests 103 and 106 until either the landing door lock switch becomes closed or the car door is opening. When the landing door lock switch becomes closed, a test 108 determines if the rebound counter is still at zero or not. If so, a step 109 sets the speed of the car door as the landing door lock switch closes equal to car door speed. A step 111 initiates a timer; note that a "timer" in one routine is not related to a "timer" in another routine. Then a test 112 determines if the landing door lock switch is open; if not, a test 114 determines if the timer has passed 150 milliseconds or not. Until either the landing door lock switch becomes open or the timer exceeds 150 milliseconds, the routine will loop between tests 112 and 114. If the landing door lock switch opens, a test 115 determines if the car door is opening; if not, this means that the landing door lock switch has rebounded into the open condition after having been closed (test 103 followed by test 112). In that case, a step 117 increments the rebounds counter and the routine reverts to test 103. On the other hand, if the landing door lock switch becomes open so that test 112 is affirmative because the car door is opening, test 115 is affirmative and a series of steps 118–121 store the time stamp and the floor number, and a feature called "landing door lock performance", along with Parameter No. 6, the number of landing door lock switch rebounds, and Parameter No. 7, the speed of the car door as the landing door lock switch closes. The feature, landing door lock performance, is not used as a parameter but may be used to trigger examination of parameters 6 or 7.

Figure 4:
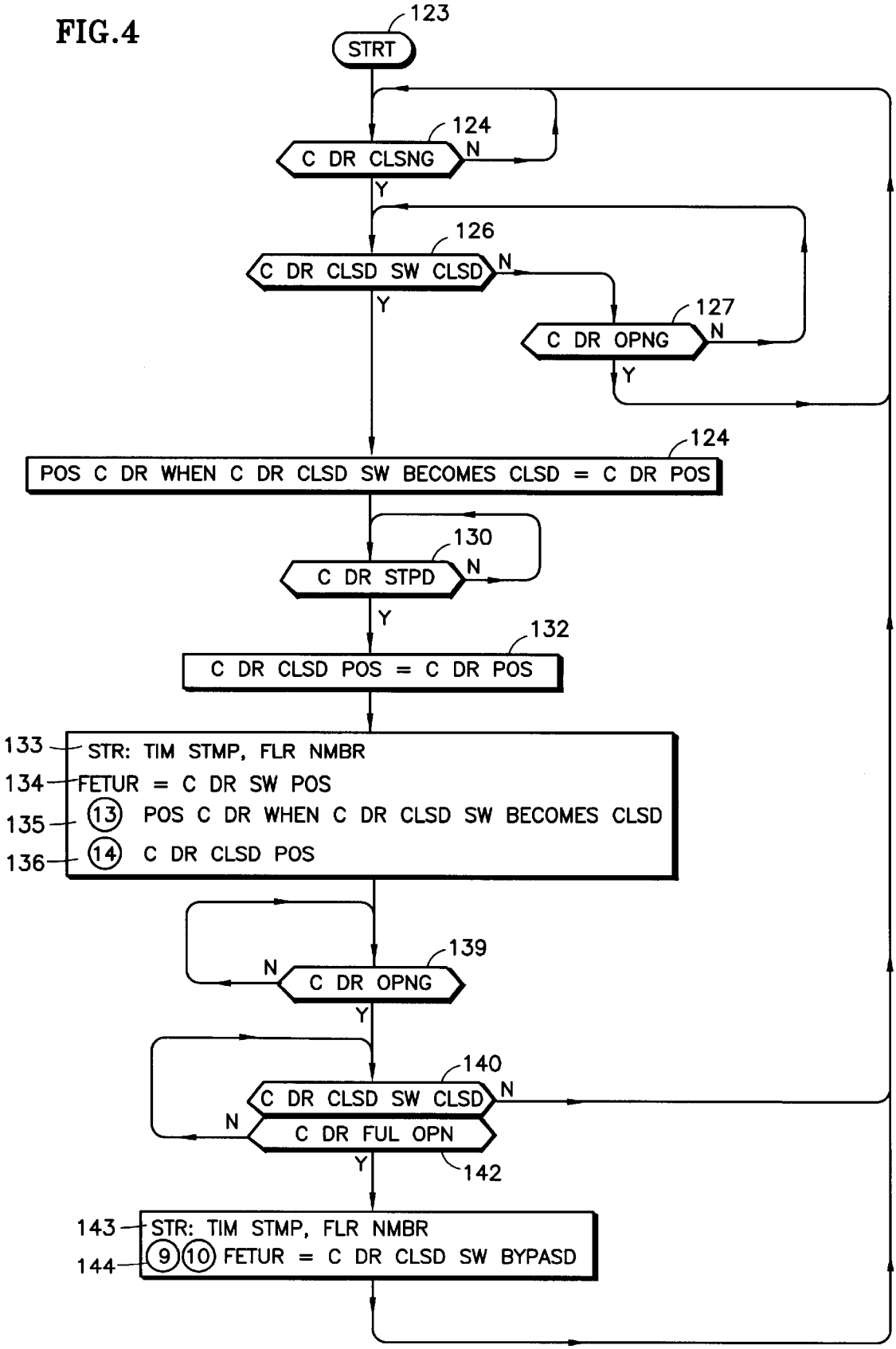

Referring to FIG. 4, a routine that determines closure of the car door closed switch, the car door closed position, and whether the car door closed switch is bypassed, is reached through a start entry point 123. A first test 124 causes the routine to wait until the car door is closing. Then a test 126 determines if the car door closed switch is closed; if not, a test 127 determines if the car door may be opening, which happens when passengers press a hall call button or a door open button, or activate a between door safety device. The routine will revert to test 124 if the car door is opening. Assuming the car door closed switch becomes closed, a step 129 sets the value of the position of the car door when the car door closed switch becomes closed equal to the present car door position. Then the routine waits at a test 130 until the car door becomes stopped. A step 132 then sets the car door closed position equal to the present car door position. A series of steps 133–136 store the time stamp and floor number, and the feature known as car door switch position. This feature is not used as a parameter but may be used for control purposes. Parameter No. 13, position of car door when car door closed switch becomes closed, and Parameter No. 14, the car door closed position, are also stored. The routine then waits at a test 139 until the car door is opening. When the car door is opening, the car door closed switch should no longer be closed. So in the normal case, a negative result of a test 140 causes the routine to revert to the start state at test 124. However, if the car door switch remains closed when the car door is opening, an affirmative result of test 140 reaches a test 142 to cause the program to cycle through both tests until the car door is fully open. Then a pair of steps 143, 144 store the time stamp, floor number and the feature known as "car door closed switch bypassed", which is a combination of Parameters Nos. 9 and 10, and indicates that the door closed switch is short circuited, or that lint or other debris are conducting across the switch's open contacts.

Figure 5:
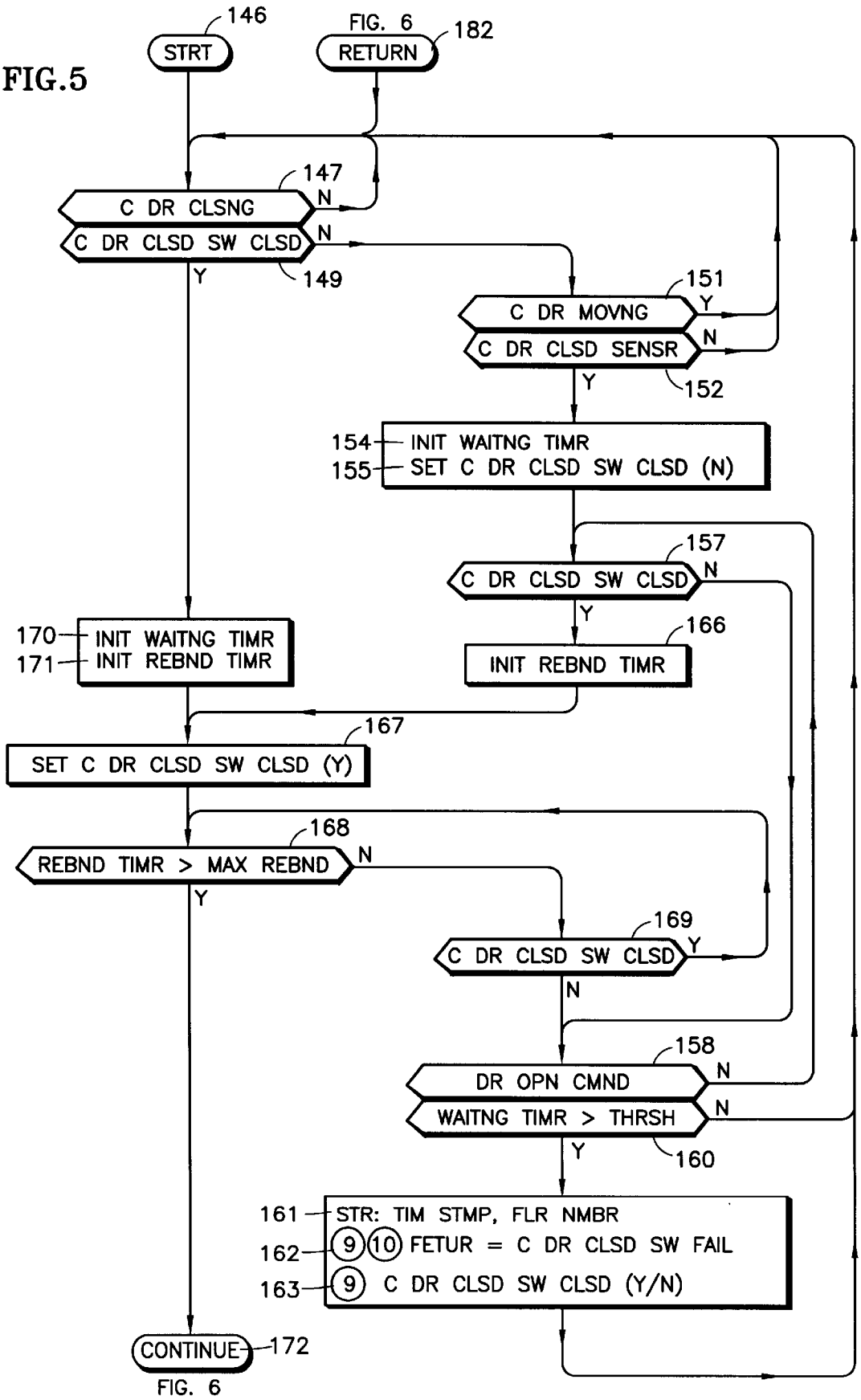
Figure 6:
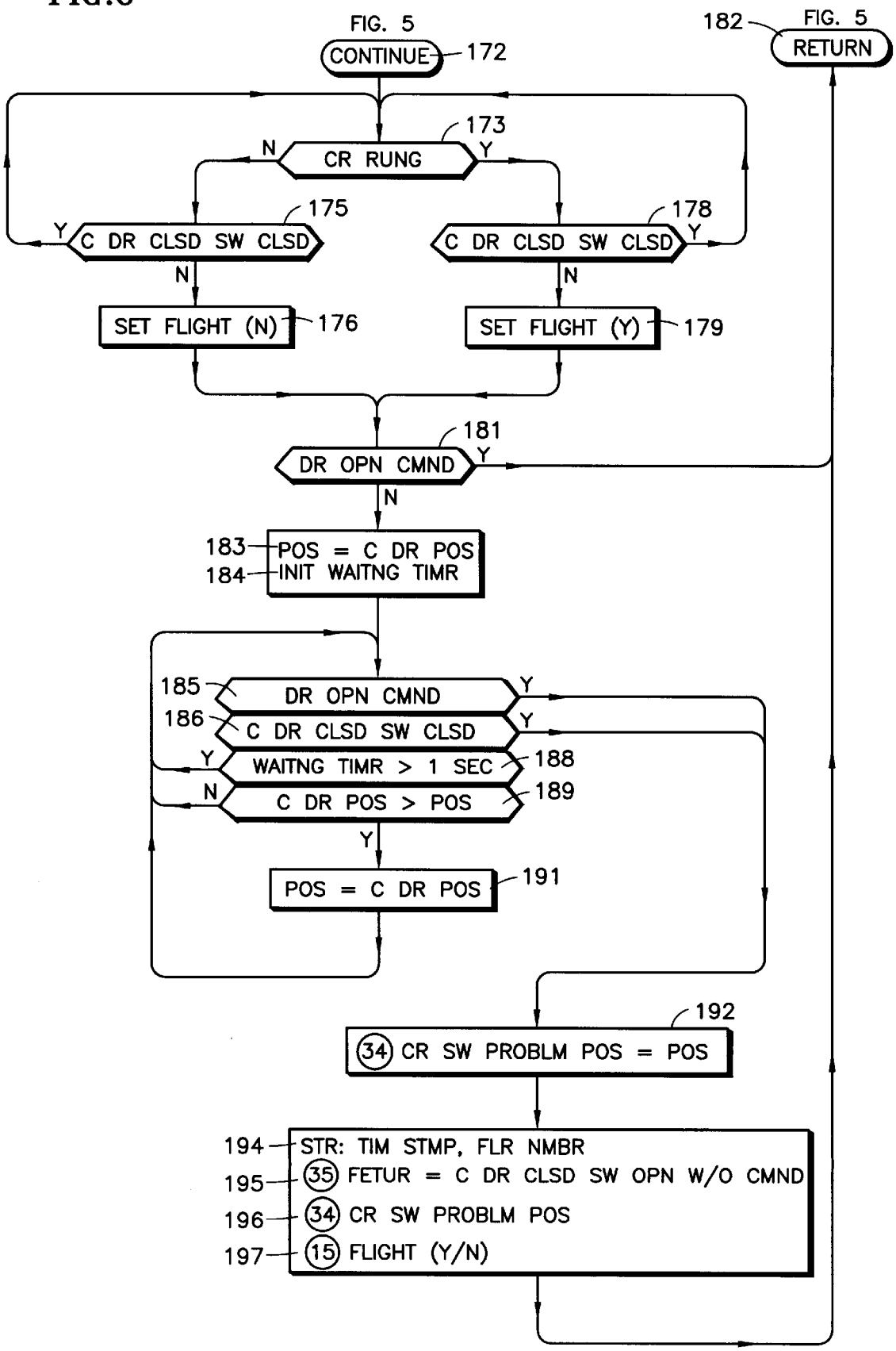

Referring to FIGS. 5 and 6, a routine which tests the car door closed switch for failure and for opening without a command is reached through a start entry point 146 and the routine then waits at a test 147 until the car door is closing. When the car door is closing, a test 149 determines if the car door closed switch is closed or not. Initially, the switch normally will not be closed when the car door begins closing, so a negative result of test 149 reaches a test 151 to determine if the car is moving. If the car is moving, the routine reverts to the start state at test 147. Normally, the car will not be moving so a negative result of test 151 reaches a test 152 to determine if the car door closed sensor is activated. In the usual case, it will not initially be activated so the program will revert to test 147 and cycle through tests 147, 151 and 152 until the car door closed sensor is actuated. When that happens, there is a potential switch failure, as described more fully hereinafter. A step 154 initiates a waiting timer and a step 155 sets the car door closed switch closed indicator to "no". A test 157 determines if the car door closed switch has closed yet or not; if not, a test 158 determines if there has been a door open command. The routine will cycle between tests 157 and 158 until either the car door closed switch becomes closed or there is a door open command. The door open command signals the end of any possibility of the car door closed switch becoming closed. A test 160 determines if a waiting timer has exceeded a threshold, such as on the order of two or three seconds. If not, this means that the failure of the car door closed switch to close is not a notable event so a negative result of test 160 causes the routine to revert to the start state at test 146. But if the timer has timed out, this means that there is a failure of the car door closed switch to close, so a series of steps 161–163 store the time stamp and floor number, and the feature named "car door closed switch failure", which is made up of Parameter Nos. 9 and 10; Parameter No. 9, car door closed switch closed (yes or no) is also stored. And then the program reverts to the start state at test 147. In a normal course of events, as the car door is closing (test 147 affirmative) the routine will pass through the steps and tests 149–155 and reach test 157 (perhaps passing through test 158 once or twice) and eventually the car door closed switch will be closed. Then a step 166 initiates the rebound timer (this is a different rebound timer than the one utilized in FIG. 2) and a step 167 will set the indicator for the car door closed switch closed to "yes". A test 169 determines if the rebound timer has timed out or not, to be sure that the car door closed switch will remain closed. The routine will cycle between tests 169 and 170 until the rebound timer times out or the car door closed switch becomes open. In that event, the routine will proceed from test 158, as described hereinbefore. Assuming the rebound timer times out with the car door closed switch still closed, an affirmative result of test 169 reaches a "continue" transfer point 172 to reach additional portions of the routine set forth on FIG. 6.

Initially, test 149 is negative; but if the door is moving, test 151 is positive, leading back to tests 147 and 149. In a normal case, the car door closed switch will close before the door stops, so test 149 will then reach steps 170 and 171 which initiate the waiting and rebound timers. Then, the routine operates as described hereinbefore.

Referring to FIG. 6, the car door switch routine is continued through the transfer point 172. A test 173 determines if the car is running; if not, a test 175 determines if the car door closed switch is closed or not. In the usual case, since this part of the program is reached only from test 149 or test 157 being affirmative, test 175 will usually be affirmative. But if the car door opens at a landing, then a negative result of test 175 will reach a test 176 to set the in-flight indicator to "no", because test 173 found the car was not running. On the other hand, if the car is running, then a negative result of test 178 will reach a step 179 to set the in flight indicator to "yes". If the door opens with the car at a landing or in flight within the door zone, it may well be a normal opening in response to a door open command. Therefore, an affirmative result of a test 181 will cause the routine to return through the transfer point 182 to the start state in FIG. 5. But if the car door switch is not closed, and there is no door open command, then that is a notable event, and a step 183 sets a position value equal to the car door position and a step 184 initiates a waiting timer. Then a test 185 determines if there is a door open command; at this stage of the routine, there initially will not be, so a negative result of test 185 reaches a test 186 to see if the car door closed switch is closed; since this part of the routine is reached from a negative result of test 175 or 178, initially the car door closed switch will not be closed, thereby reaching a test 188 to see if the waiting timer has passed one second yet. Initially, since it was set in step 184, it will not have passed one second. In this embodiment, low values of door position are toward the door being closed, and high values toward open. A test 189 checks if the present car door position is greater than the position value, which it will be if the car door is still opening, thereby indicating a door-open problem. An affirmative result of test 189 reaches a step 199 to update the position value to the present car door position. Then the routine reverts to the test 185 and 186 to see if either there is a door open command or the car door closed switch has finally closed. So long as neither of these occur, the routine will cycle through tests and steps 185 through 188. Once test 188 is affirmative, the car door position is no longer updated. If the car door is closed, and the problem is in the switch, then the position will not be less than the car door position and no updating occurs in step 191. Similarly, if the car door stops, then the position is no longer updated. The position of the car door, whether it be because the car door has stopped or whether it be because the one second has timed out, gives an indication of whether the problem is in the switch or the door mechanism. Eventually, there will either be a door open command or the car door closed switch will become closed (for instance if the car door had been opened by a passenger and now is allowed to close again) so an affirmative result of one of the tests 185, 186 will lead to a step 192 which sets Parameter No. 34, car switch problem position, equal to the position set in steps 183 and 191. Then a pair of steps 194, 195 store the time stamp and floor number, as well as Parameter No. 35, a feature called "car door closed switch open without command". Parameter No. 34, the car door switch problem position, and Parameter No. 15, whether the door opening was in flight, yes or no, are also stored in steps 196 and 197. And then the program reverts to the start state in FIG. 5 through the return transfer point 182.

Figure 7:
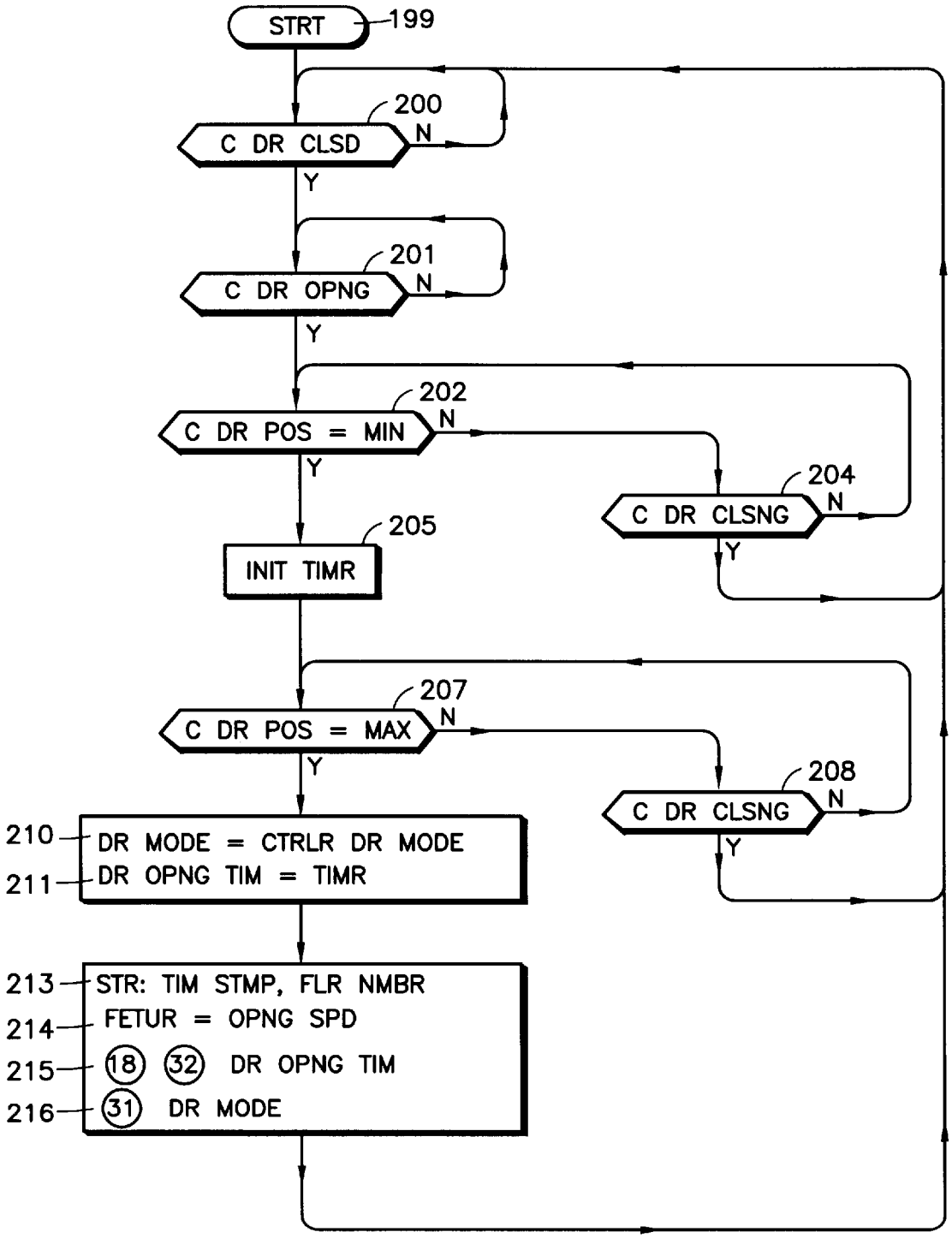

Referring to FIG. 7, a routine relating to door opening time is reached through a start entry point 199 and waits at a test 200 until the car door is closed. Then the routine waits at a test 201 until the car door is opening. Measuring of opening time will begin as soon as the car barely opens to a minimum position, as is determined by a test 202. But if the test 202 is negative, a test 204 determines if the car door is closing, such as when it opens only part way before closing in the nudging mode to prevent further door reversals; in which case the routine will revert to the start state at test 200. In the normal course, the door will quickly reach the minimum position and a step 205 will initiate a timer. As the door opens, the routine cycles between a test 207 to see if the door is essentially fully open at a maximum position, and a test 208 to see if the car door is closing. If the car door begins to close, the test is terminated by the routine reaching the start state at test 200. When the door does reach the maximal position, a step 210 sets a door mode indicator equal to whatever the door controller mode is: the door modes may be opening or closing normally, or opening or closing at a low constant door motor current; a test 211 sets the door opening time equal to the timer setting. Then a series of steps 213–215 store the time stamp and floor number, the feature called "opening speed", as well as door opening time, which can be either Parameter No. 18, average time required to open car door at constant door motor current, or Parameter No. 32 time it takes for the door to open, depending on Parameter No. 31, door mode, which is stored by a step 216. Then the routine reverts to the stop state at the test 200.

Figure 8:
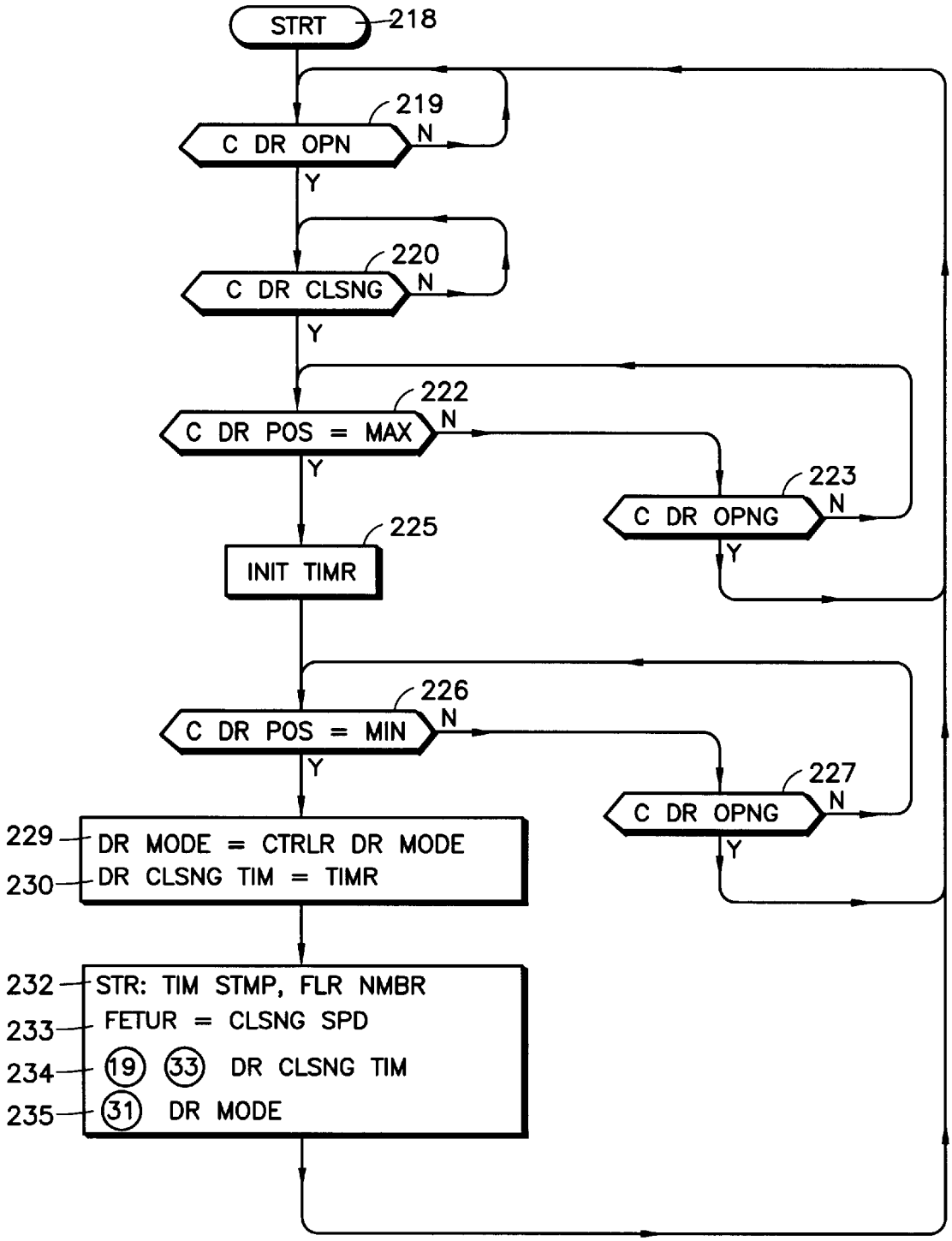

FIG. 8 illustrates a routine for measuring door closing time. Since it is exactly the same as FIG. 7, except relating to closing instead of opening, further description is not required.

Figure 9:
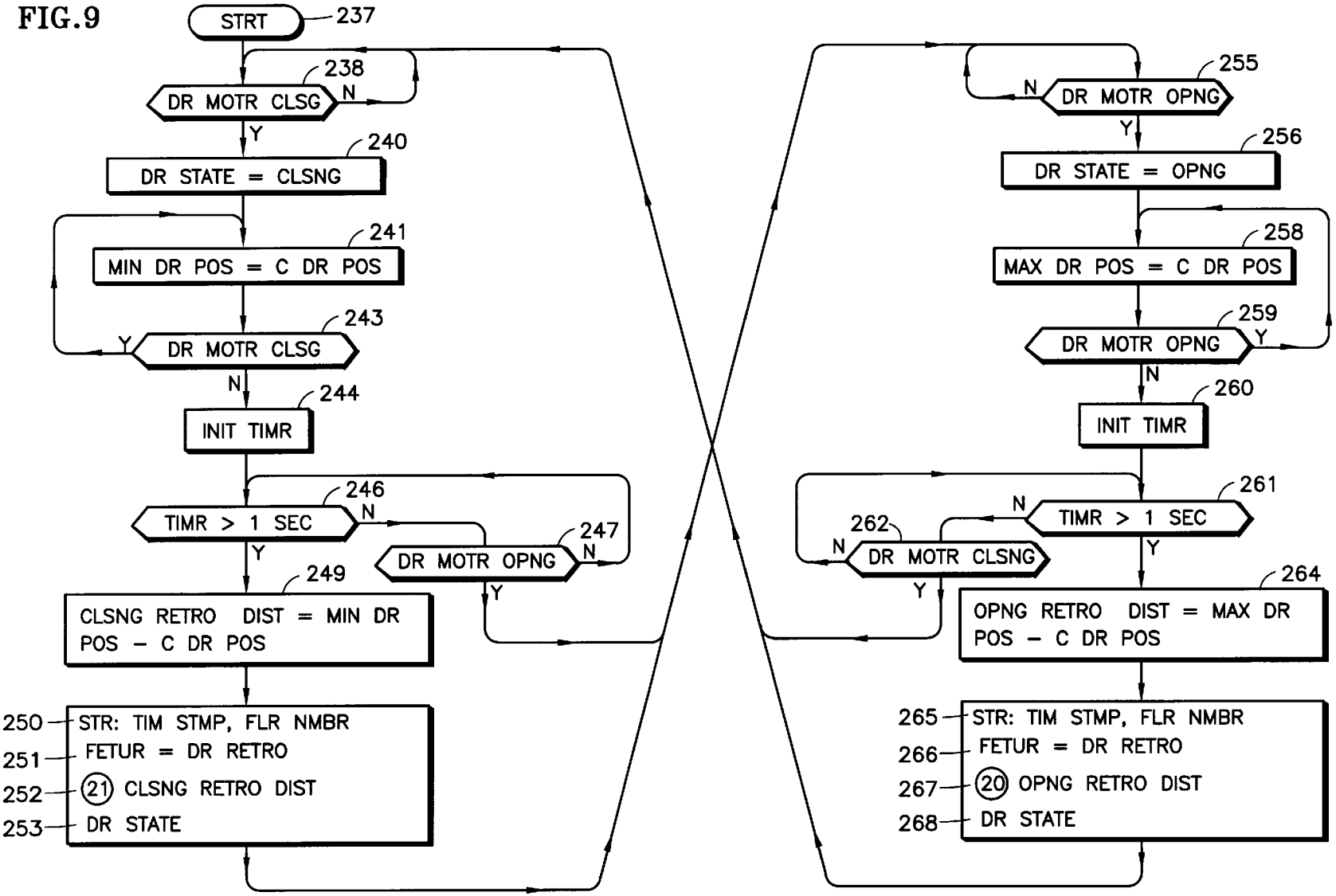

The routine of FIG. 9 determines door distance when the door does not remain fully open or fully closed, due to friction. The routine is reached through a start entry point 237 and then waits at a test 238 until the door motor is closing, which can be determined by the door controller command to the door motor. Once the door motor is closing, a step 240 sets the door state to closing. A step 241 sets the minimum door position equal to the car door position and continuously updates the minimum door position so long as a test 243 indicates that the door motor is still closing. Once the door motor is no longer closing, a step 244 initiates a timer and a test 246 continuously checks to see when the timer has exceeded one second. So long as one second has not passed, a test 247 determines if the door motor is opening or not; if it is, the retrocession test (hereinafter) cannot be made, and an affirmative result of test 247 will cause the routine to advance to the opening tests and steps. In the usual case, if a door open command has not occurred within one second after the door motor ceases to be operating in the closing direction, then the door will remain closed. Then, a step 249 sets the closing retrocession distance equal to the minimum door distance finally established in step 241 minus the present car door position. Then a series of steps 250–253 store the time stamp, the floor number, and a feature called "door retrocession"; Parameter No. 21, the closing retrocession distance, and the door state are also stored. Then the program advances to and waits at a test 255 until the door motor is opening. Then steps and tests 256–268 are performed which are the same as steps and tests 240–253, except that they relate to opening instead of closing. Therefore, further description is not required.

Figure 10:
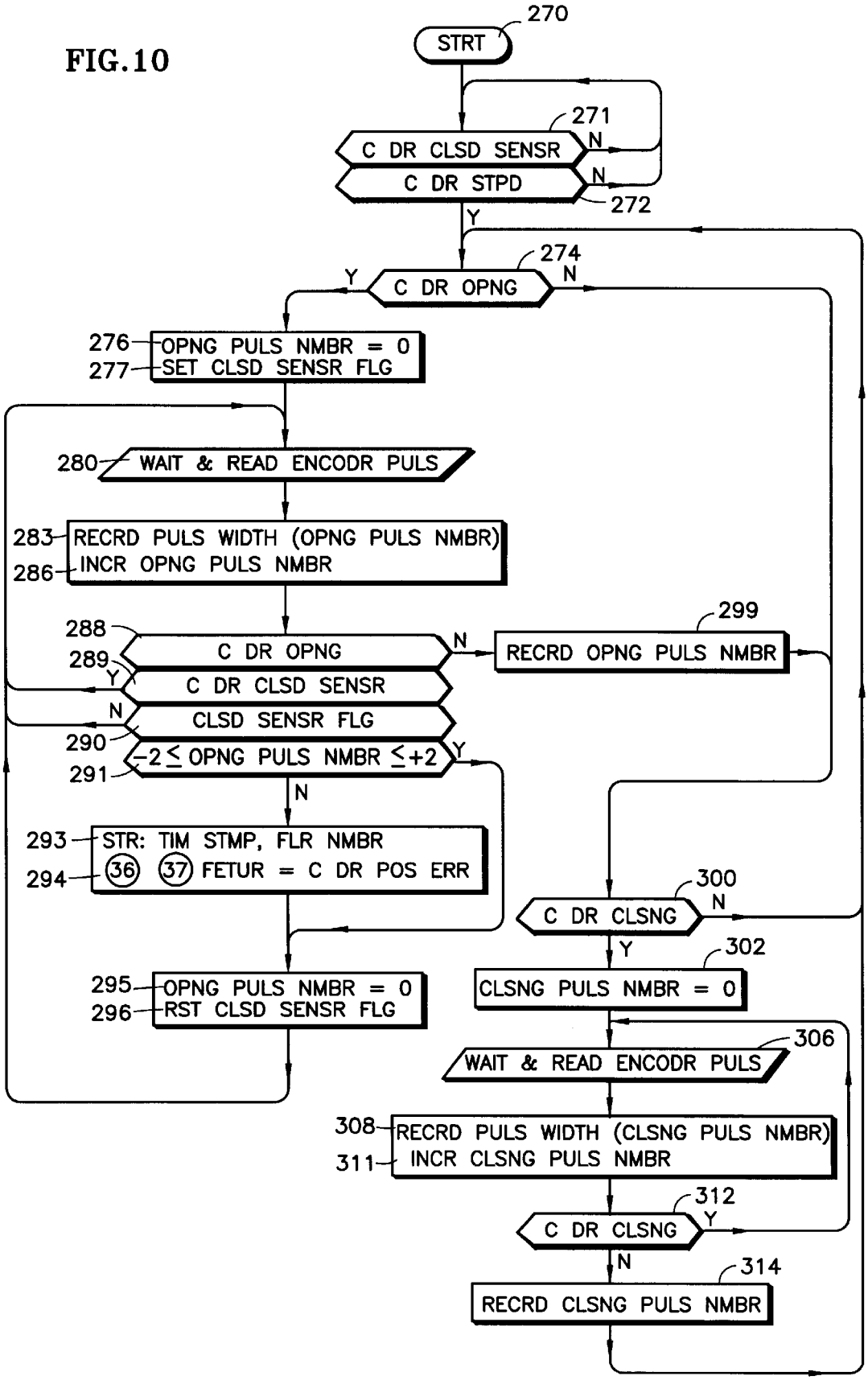

A routine that determines whether or not there is a car door closed sensor position error is reached in FIG. 10 through a start entry point 270, and the routine then waits at tests 271 and 272 until the car door closed sensor is actuated and the car door is stopped. Then a test 274 determines if the car door is opening. If not, a test 300 determines if the car door is closing. If not, the routine reverts to the test 274. After the car door closed sensor is actuated and the car door is stopped, the next thing to occur will be the car door opening and then a pair of steps 276, 277 set an opening pulse number equal to zero, and set a closed sensor flag which is used in this routine as described hereinafter. Then a subroutine 280 causes the routine to wait and eventually read an encoder pulse when one is emitted from the door position encoder. Each encoder pulse is indicative of so many degrees (or fractions of a revolution), and translates directly to distance of the door position. Thus, knowledge of the pulse count is equivalent to knowledge of the door position. At the same time, the pulse separation (referred to hereinafter as "pulse width") is inversely related to the speed of the door. Each time that the encoder emits a pulse, the routine reaches a pair of steps 283 where the pulse width is recorded as being related to the current opening pulse number, which initially is some negative number, due to the convention established herein that pulse number zero is defined as the pulse where the door closed sensor is no longer activated (no longer indicates the door being closed). And then the opening pulse number is incremented in a step 286. A test 288 determines if the car door is still opening; in the usual case it will be so a test 289 determines if the car door closed sensor is actuated, or not. In the first fractions of a second when the car door begins to open, the car door closed sensor will still be actuated so an affirmative result causes the routine to revert to the subroutine 280 to read another pulse, record its width and increment the opening pulse number once again. The program will thus loop through test and steps 280–289 until the car door closed sensor is no longer actuated. Then a test 290 determines if the closed sensor flag, set in step 277, is still set. Initially it will be, so an affirmative result of test 290 reaches a test 291 to see if the opening pulse number is within two pulses of zero, which is the true door closed position and the correct position for the door closed sensor. If it is not within the desired range, then a pair of steps 293, 294 store the time stamp and floor number along with a feature called "car door position error", which is comprised of Parameter No. 36 (car door leaving a closed position sensor as it opens) contemporaneous with Parameter No. 37 (a true car door closed position). On the other hand, if there is no error in the door position, an affirmative result of test 291 will bypass steps 293 and 294. Then a step 295 names the current pulse "zero" to satisfy the convention; the pulse identification of the door closed sensor position is upgraded in every pass through the routine at step 295. A step 296 resets the closed sensor flag so that in subsequent passes through the steps and tests 280–290 the door closed position sensor test 291 will not be performed, as the door continues to open. When the car door is fully open, the test 288 will be negative reaching a step 299 which records the opening pulse number, indicative of the number of pulses which have occurred and therefore the actual open position of the car door once it ceases opening. This number is used in FIGS. 11–14 as described hereinafter. The routine will then loop through tests 300 and 274 until the door begins closing. Then a step 302 sets the closing pulse number equal to zero and the subroutine 306 waits to read the next encoder pulse, when it occurs. After the next encoder pulse is read, a pair of steps 308, 311 record the pulse width in association with the closing pulse number and then the closing pulse number is incremented in a step 311. A test 312 determines if the car door is still closing. So long as it is, the routine will read successive pulse numbers and record the pulse width. However, once the car door stops closing, a negative result of test 312 reaches a step 314 to record the closing pulse number for use in FIGS. 11–14.

Figures 11, 12:
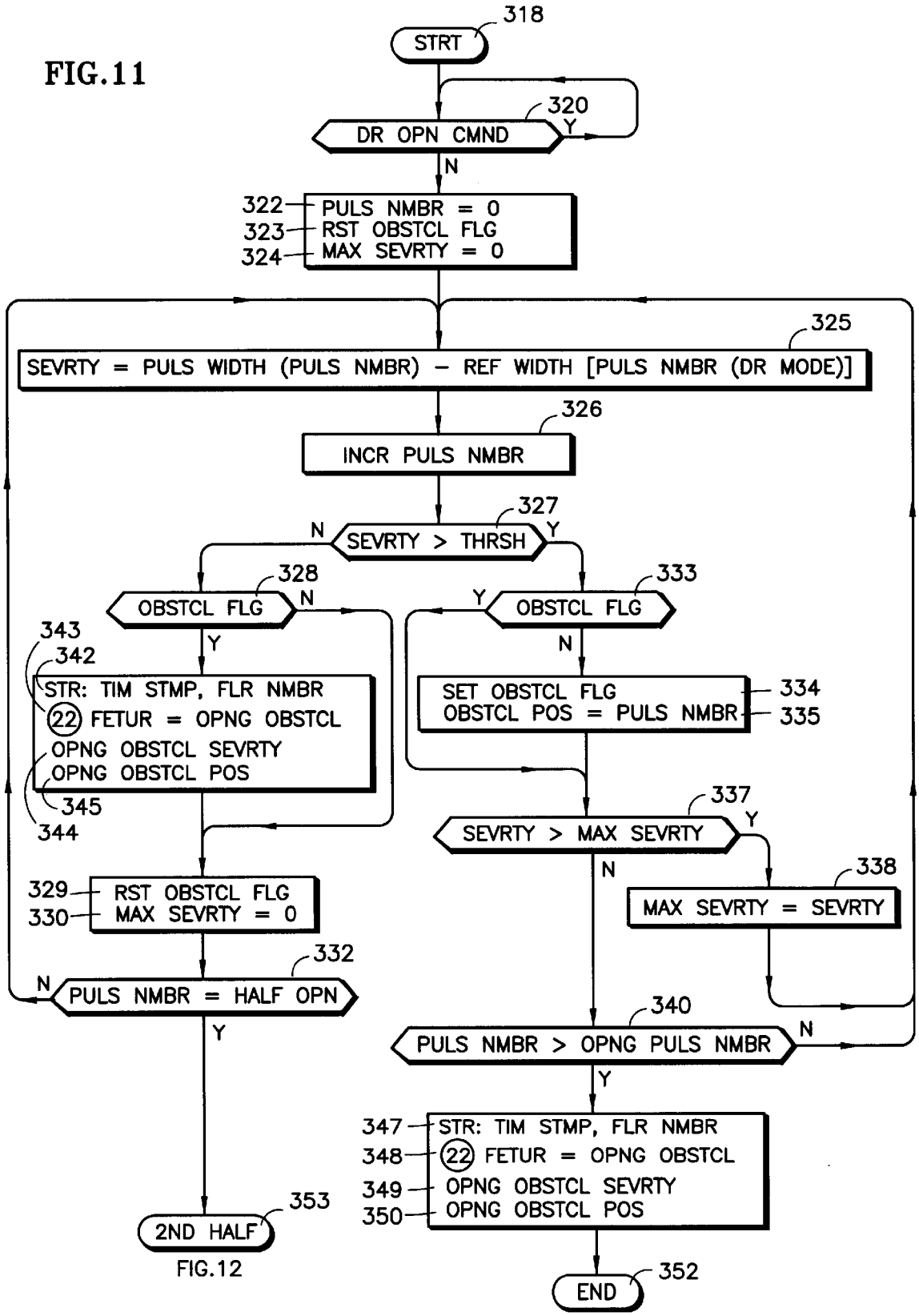
Figure 12:
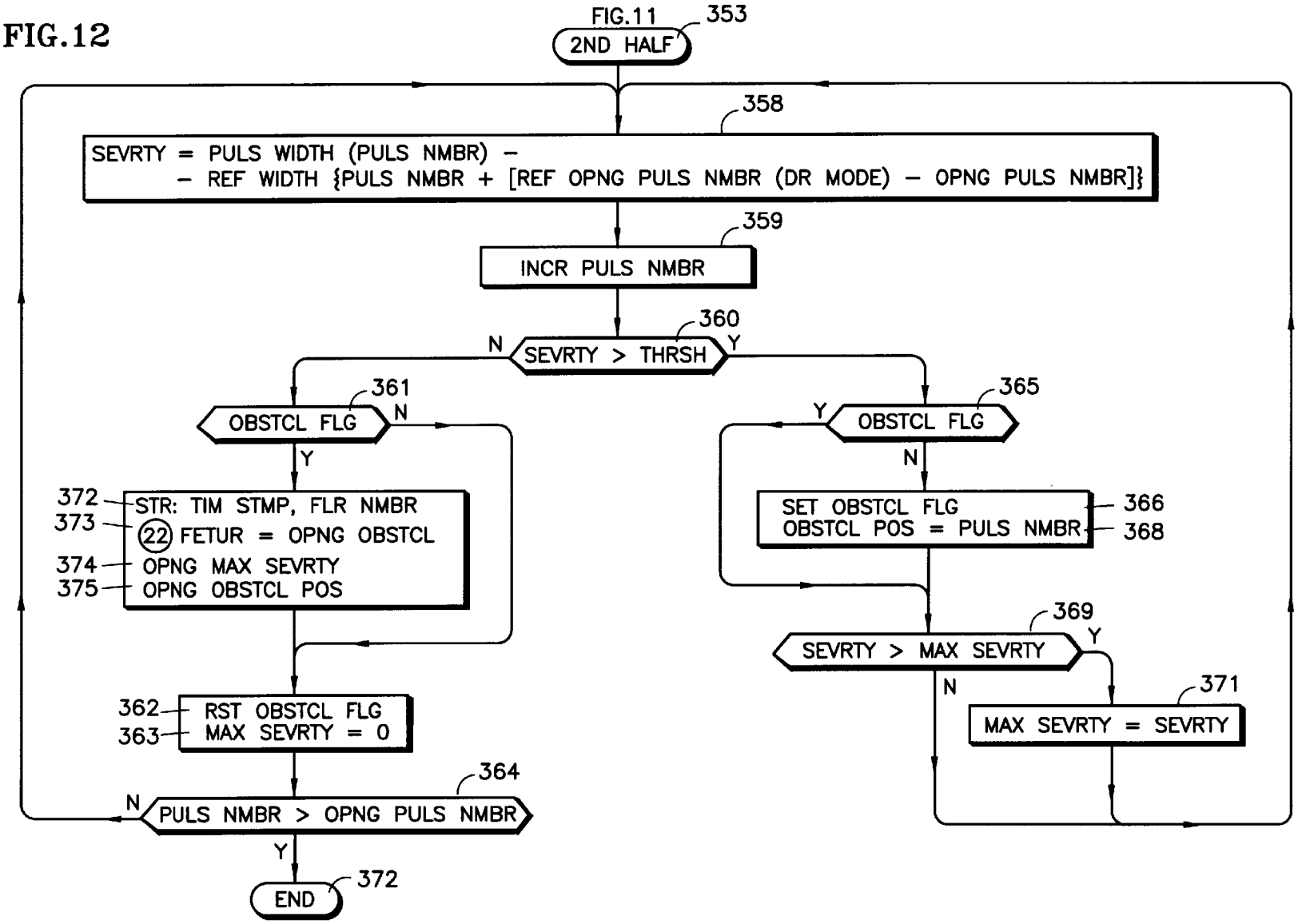

A routine that checks for obstacles or other impediments that slow the door down is reached in FIG. 11 through a start entry point 318, and the routine waits at a test 320 until the end of a door open command, indicating that the process of recording pulse widths as the door opens has finished, so that this routine can begin. Then, a series of steps 322–324 initialize a pulse number used in the routine equal to zero, reset an obstacle flag used in the routine, and initialize the maximum severity (the severity of slowing the car door down) to zero. Pulse widths stored according to pulse number as described in FIG. 10 are then compared against previously determined reference pulse widths in a step 326. The severity of slowing down is equal to the pulse width of a particular pulse number minus the reference width for that same particular pulse number of a reference door motion profile for the particular door mode of the door when the pulse widths were recorded as described in FIG. 10. Then the pulse number is incremented in a step 326 and a test 327 determines if severity exceeds a threshold. If the car door is slowed just a small amount which is inconsequential, the extra width between pulses will be less than the threshold, so a test 328 determines if the obstacle flag (reset in step 323) has been set or not. Until severity exceeds the threshold, the obstacle flag will not be set, so a pair of steps 329, 330 reset the obstacle flag (in this case, redundantly) and reestablish maximum severity at zero, for purposes described hereinafter. Then a test 332 determines if the pulse number is high enough to indicate that the door is half open. Initially it will not be, so severity of another pulse is determined in step 325 once again. Assume now that there is a significant obstacle so that severity is greater than the threshold in test 327. A test 333 determines that the obstacle flag has not yet been set, so that a step 334 will set the obstacle flag and a step 335 will set the obstacle position equal to the pulse number. Then a test 337 determines if the severity sensed in step 325 exceeds the previously established maximum severity; initially, any severity greater than the threshold will be higher than the zero maximum severity set in step 324, so an affirmative result of test 337 will reach test 338 to set the maximum severity equal to the severity most recently set in step 325. Then the program reverts to step 325, and again the test 327 determines if severity is more than the threshold. Assuming there is an obstacle, there will be several pulses exceeding the threshold so affirmative results of step 327 will reach test 333 which now is affirmative since the obstacle flag has been set. Test 337 will continue to be affirmative and step 338 will continue to update the value of maximum severity until the peak of the slowdown is reached. Thereafter, severity will no longer be greater than maximum severity so a negative result of test 337 reaches a test 340 which determines if the current pulse number exceeds the opening pulse number (the pulse number at the point where the door stopped as described in FIG. 10). In the general case, within the first half of the pulses, the pulse number will not exceed the opening pulse number so a negative result of test 340 reverts the program to the step 325. Thereafter, the routine will proceed through test 327, test 353, test 337 and test 340 until the severity no longer exceeds the threshold, indicating that the end of the obstacle or other impediment has been reached. Then a negative result of test 327 reaches test 328 which is now affirmative, so a series of steps 342–345 store the time stamp and floor number, a feature called "opening obstacle" which is Parameter No. 22, the value of the maximum severity determined in step 338, and the obstacle position provided by step 335. It should be understood that position will be determined by converting the pulse number into distance, a relationship which is fixed in any given door. After the peak of one obstacle or other impediment has been reached, and the event has been stored in steps 342–345, the obstacle flag and maximum severity are reset in steps 329 and 330 so the system will be ready to deal with an additional obstacle, should there be one.)

If the door had become stuck in the first half of its motion as it opened during the procedures described with respect to FIG. 10, the test 340 would be affirmative reaching a series of steps 347–350 which store the time stamp and the floor number, Parameter No. 22, the feature called "opening obstacle", the maximum severity and obstacle position, all as described hereinbefore.

In the normal course, the routine will continuously pass through the step 325 looking for slow downs at test 327. If the door does not get stuck during the first half of its opening movement, eventually test 332 will be affirmative causing the routine to continue in FIG. 12 through a "second half" transfer point 353.

Figure 13:
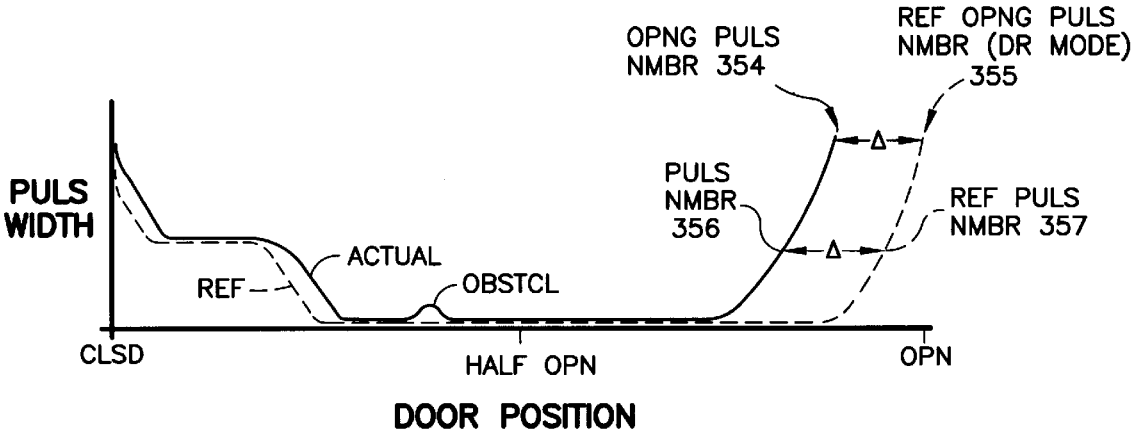
FIG. 13 is a plot of position encoder pulse width versus door position.

Referring to FIG. 13, if the door does not open as fully as the door opened when the reference pulse widths were recorded along with the reference pulse numbers, during a previous special test, then the actual speed profile will have increasing pulse widths (denoting deceleration to a stop) at lower pulse numbers than is the case in the reference speed profile. The actual opening pulse number is indicated in FIG. 13 at 354, for the actual door motion profile, and the reference opening pulse number, for a particular door mode, is illustrated at 355. In FIG. 11, the second half of the routine begins with the difference, Δ, of FIG. 13 being determined within the square brackets of a step 358 as the reference opening pulse number for the given door mode, minus the actual opening pulse number, to which the pulse number is added before determining the reference pulse number from which the reference width should be taken.

The remainder of FIG. 12 operates in a fashion which is identical to that described with respect to FIG. 11 hereinbefore, and further description is not needed.

Figure 14:
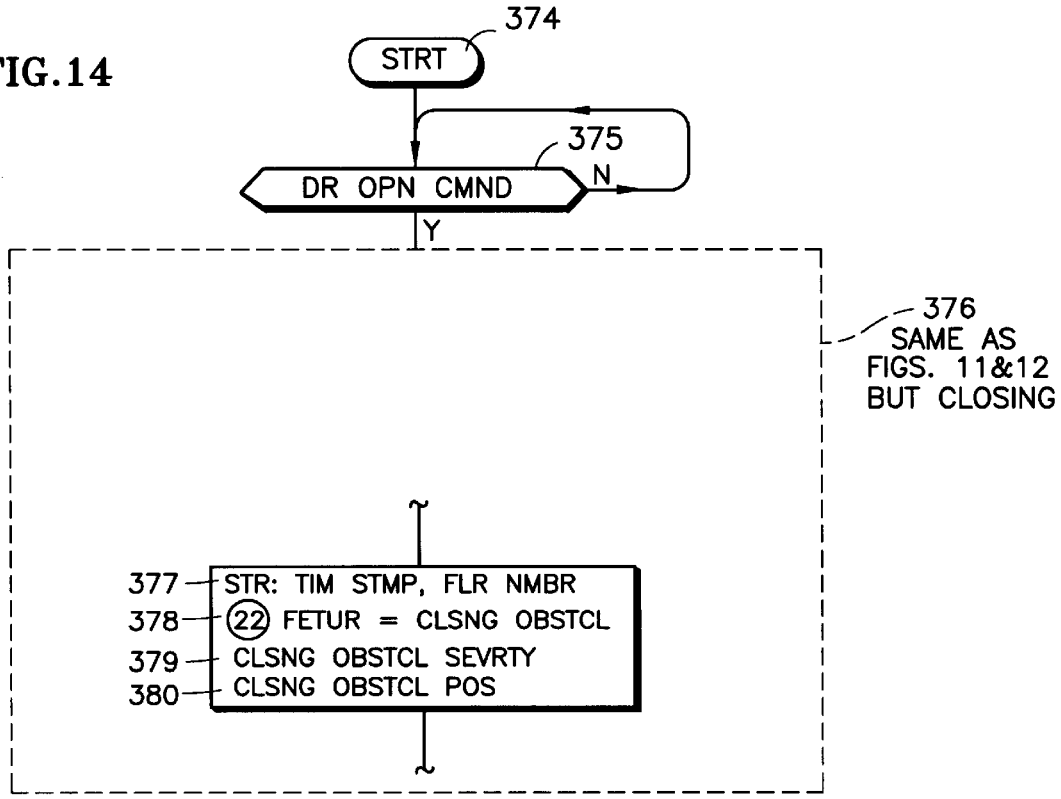
FIGS. 14–25 are logic flow diagrams of routines related to various parameters and features as follows.

In FIG. 14, obstacles to the door closing are detected in a manner that is identical to opening obstacles described with respect to FIGS. 11–13, so further description is unnecessary.

Figure 15:
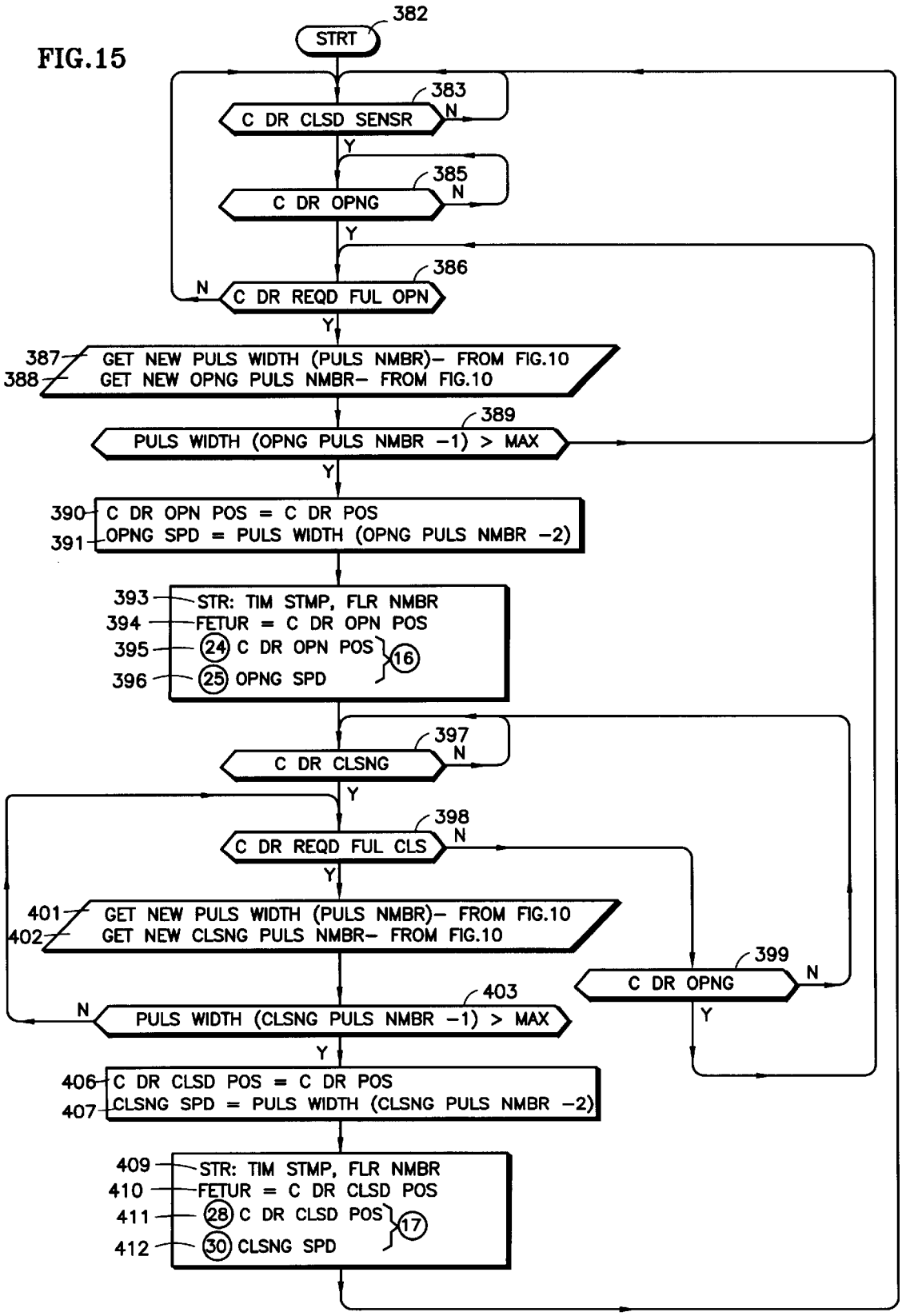

In FIG. 15, a routine which provides car door open and closed position, and opening and closing speeds, is reached through a start entry point 382, and the routine waits at a step 383 until the car door closed sensor is actuated, indicating that the car door is fully closed. Then the routine waits at step 385 until the car door is opening. A test 386 determines if the car door is required to fully open; normally it is, but it may not be, such as during nudging (after many door reversals). Then a subroutine is reached having a portion 387 which will get a new pulse width as soon as one is available from the subroutine 280 in FIG. 10 and a portion 388 which gets the current opening pulse number as soon as it is established in step 286 of FIG. 10. This is possible because both routines run at the same time, since the test 274 in FIG. 10 as the same as the test 385 in FIG. 15: car door opening. Then a test 389 determines if the pulse width of the pulse number which is one less than the current opening pulse number has a width that exceeds a maximum; if it does, this means that the car is almost stopped. If not, the routine loop backs to test 386 to get another pulse width and another opening pulse number and to test the pulse width to see if it is wide enough to indicate that the car is essentially stopped. Eventually, an affirmative result of test 389 will reach a step 390 to set the car door open position equal to the current car door position, and a step 391 to set opening speed equal to the pulse width of a pulse number which is two less than the ultimate opening pulse number. The pulse width of that pulse can be converted accurately to the car door speed, and the pulse number two less than the ultimate opening pulse number is chosen since that is a final opening speed just before the car door is stopped. Next, a series of steps 393–396 store the time stamp and floor number and a feature called "car door open position"; Parameter No. 24, car door open position and Parameter No. 25 opening speed are also stored.

In FIG. 15, the routine then waits until a test 397 indicates that the car door is closing; then a test 398 determines if the car door is required to close fully. If not, a test 399 determines if the car door is opening, which frequently happens because of passenger activation of a between door safety device, a door close button, or a hall call button. If the car door is opening, then the program reverts to the test 386, as described hereinbefore. If the car door is not opening, the routine reverts to test 397 and 398 waiting for a full door closing operation. When that occurs, a subroutine is reached having a portion 401 to get a new pulse width and associated pulse number from FIG. 10, and a portion 402 to get a new closing pulse number, also from FIG. 10. Then a test 403 determines if the most recent pulse width of the pulse number which is one less than the closing pulse number is greater than a maximum value, indicative of the car door being essentially stopped, and therefore fully closed. If not, the routine loops through the test and steps 398–403 until the door is closed. Then, the step 406 sets the car door closed position equal to the current car door position, and a step 407 sets the closing speed equal to the pulse width of a pulse number which is two less than the closing pulse number; this pulse width can be converted to the final closing speed of the door. A set of steps 409–412 store the time stamp and floor number and a feature called "door closed position"; Parameter No. 28, car door closed position, and Parameter No. 30, closing speed are also stored. Then the program reverts to the start state at test 383.

Figure 16:
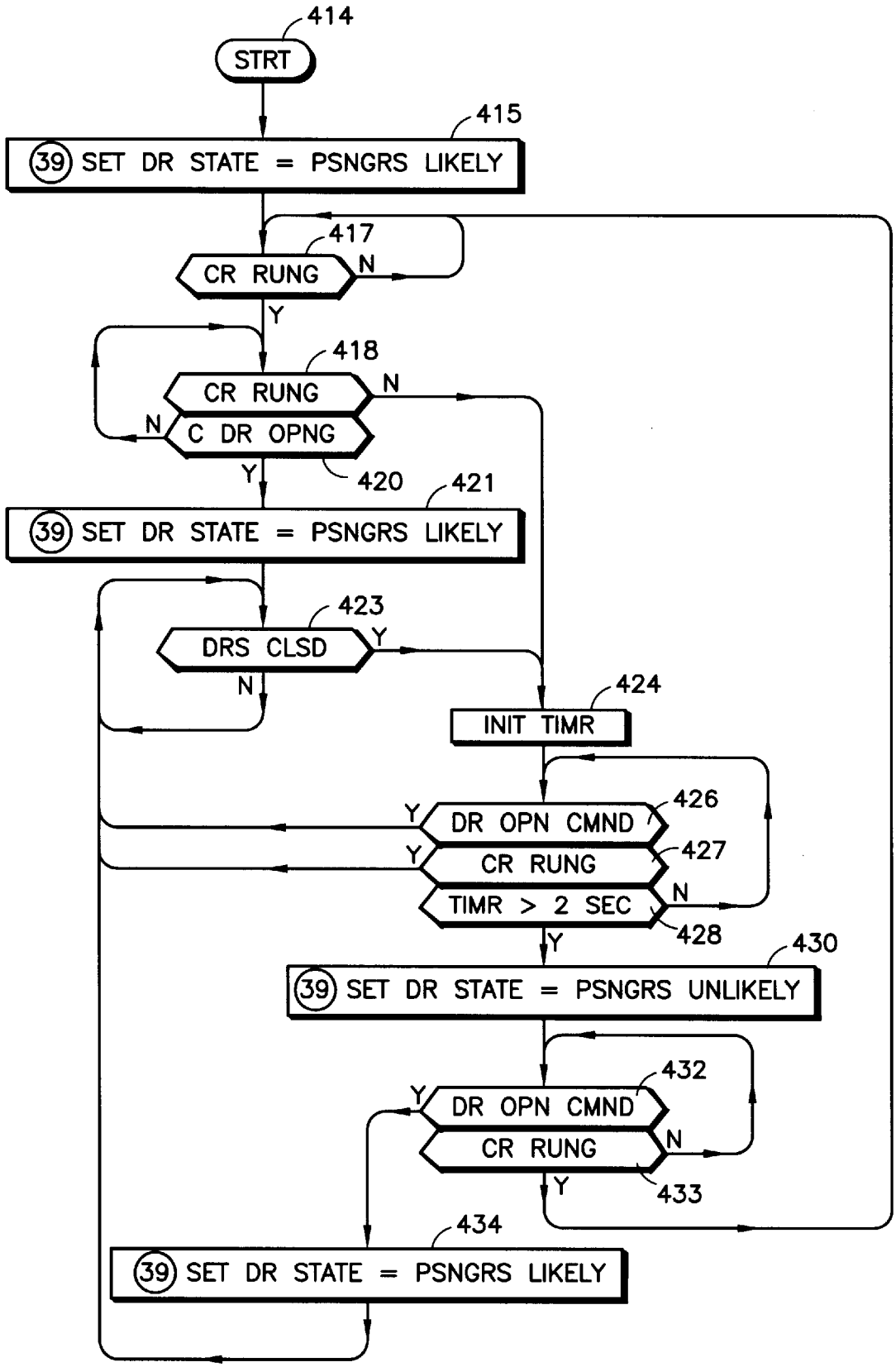

In FIG. 16, a routine determines if the car door has been closed with the car at a landing for a period of time, such as two seconds, or which indicates that it is unlikely that passengers are interacting with the door. Otherwise, it is determined that it is likely that passengers are interacting with the door. In FIG. 16, the routine is entered through a start entry point 414 and a step 415 sets the door state, which is Parameter No. 39, to indicate passengers are likely (to interact with the door). The routine then waits at test 417 until the car is running. Then the routine advances through tests 418 and 420 to determine if the car door is opening while the car is still running, or not. If the car stops running before the car door opens, this means that the car is being parked and passengers interacting with the door is unlikely. But if the car door starts opening while the car is still running, this means it has reached a door zone at a landing, and interaction of passengers with the door is likely. Therefore, a step 421 sets the door state to indicate passengers are likely (perhaps redundantly) and the routine then waits at a test 423 until the doors are closed. Once the doors are closed, it is not likely that the passengers will interact with the doors, so a step 424 initiates a timer. However, if there is a door open command, then a test 426 will cause the routine to revert to the test 423. If the car is running, a test 427 causes the program to revert to test 423. But if both tests 426, 427 are negative, then a test 428 determines if the timer has reached two seconds or not. If not, the routine waits at tests 426–428 until the timer times out. Then a step 430 sets the door state to indicate that interaction of passengers with the door is unlikely. A pair of steps 432, 433 determines if the car door open command appears before the car starts to run. If it does, then a step 434 sets the door state to indicate that the interaction of passengers with the door is likely, and the program reverts to the test 423. However, if the car is running before there is a door open command, then the routine reverts to the test 417. Thus, the door state indicates that interaction of passengers with the car door is unlikely when the car door is parked (not running) with the doors closed for a predetermined time (such as two seconds).

Figure 17:
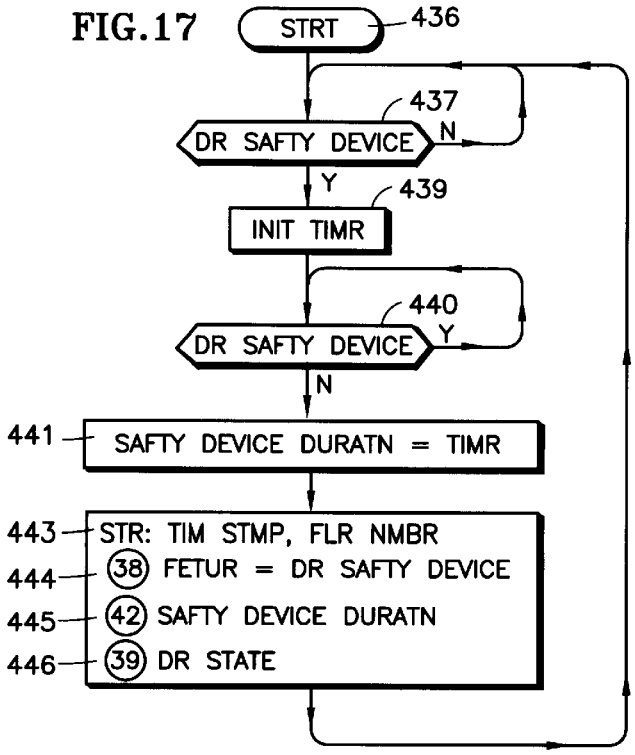

In FIG. 17, a routine which determines operation and duration of operation of a between-door safety device is reached through a start entry point 436 and the routine then waits at a test 437 until the door safety device is actuated. Then a timer is initiated in a step 439 and the routine waits at a test 440 until the door safety device is no longer actuated. When that happens, a step 441 sets the safety device duration equal to the setting of the timer. Then a series of steps 443–446 store: the time stamp and floor number; Parameter No. 38, which is the feature known as "door safety device"; Parameter No. 42, the safety device duration; and Parameter No. 39, the door state which is established in FIG. 16. Then the program reverts to the start state at the test 437.

When dealing with hall call buttons and lights and car call buttons and lights, it should be borne in mind that the landing related thereto is different from the floor number (which is generally recorded in most of the routines hereinbefore) because the landing number relates to the floor for which a call is being entered, whereas the floor number relates to the position of the elevator car.)

Figure 18:
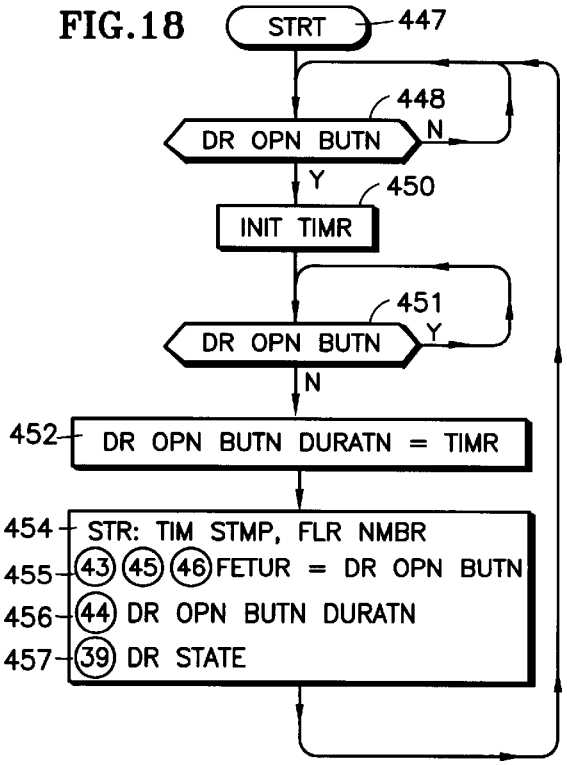
Figure 19:
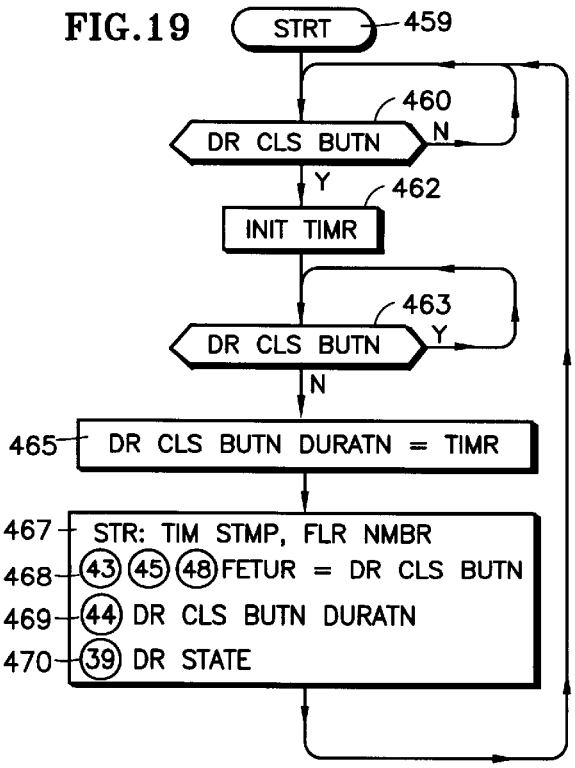

Routines that similarly sense operation of a door open button or a door close button, and the duration that the buttons are operated, are set forth in FIGS. 18 and 19; because these routines operate exactly as described with respect to FIG. 17, except relating to the door buttons, further description is not required.

Figure 20:
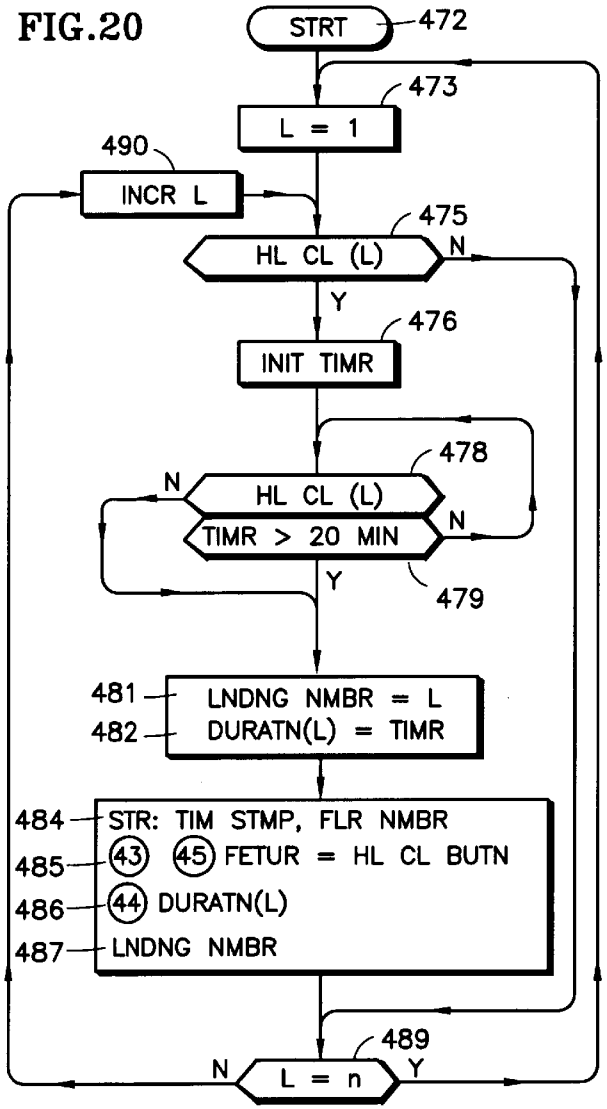

A routine for recognizing stuck hall call buttons (also called landing call buttons herein) is reached in FIG. 20 through a start entry point 472 and a first step 473 sets a landing counter value, L, equal to one. A test 475 determines if a hall call button for landing L is pressed; if it is, a step 476 initiates a timer and then the routine waits at tests 478 and 479 until either the hall call button is released or 20 minutes have expired. Then a step 481 sets the landing number equal to L and a step 482 sets the duration for landing L to the setting of the timer. A pair of steps 484, 485 store the time stamp and floor number as well as Parameter No. 43, a feature called "hall call button". Then Parameter No. 44, the duration for landing L, and the landing number are stored by steps 486, 487. Then a test 489 determines if all of the landings in the building have had their hall call buttons tested or not; initially, they will not so a negative result of test 489 reaches a step 490 to increment L, and the routine repeats for the next landing in turn. If on the other hand, the hall call button for landing L had not been pressed in the first instance, a negative result of test 475 will have bypassed steps and tests 476–487. When all landings have been tested, an affirmative result of test 489 causes the routine to revert to the start state at step 473.

Figure 21:
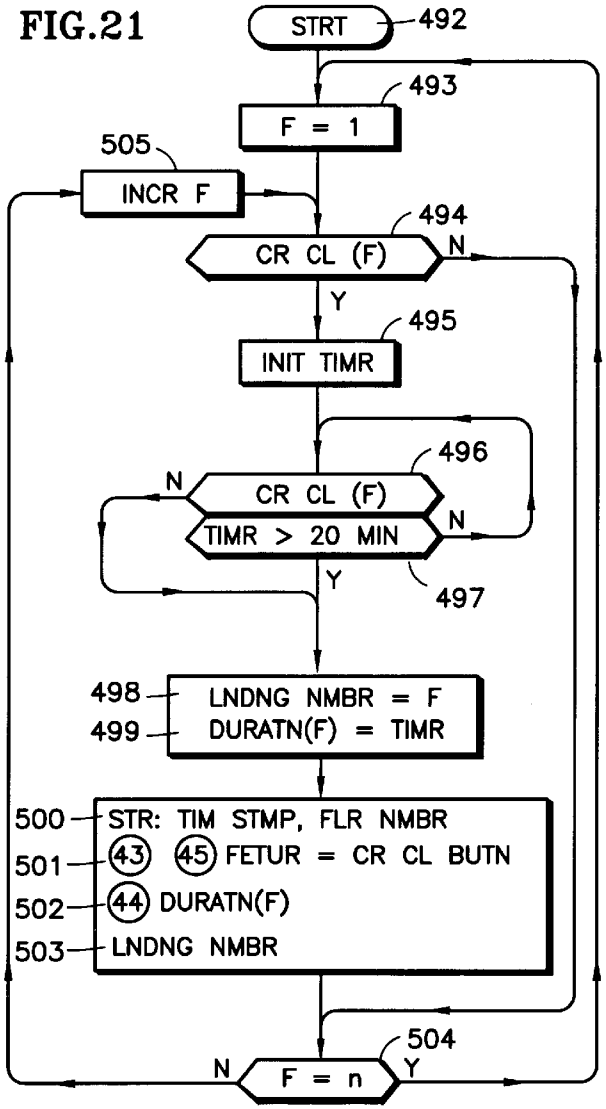

The routine of FIG. 21 which determines operation and duration of car call buttons operates identically to FIG. 20, and further description is not required. However, it should be understood that both Parameter No. 43 and Parameter No. 44 relate to either a hall call (landing call) button or a car call button.

Figure 22:
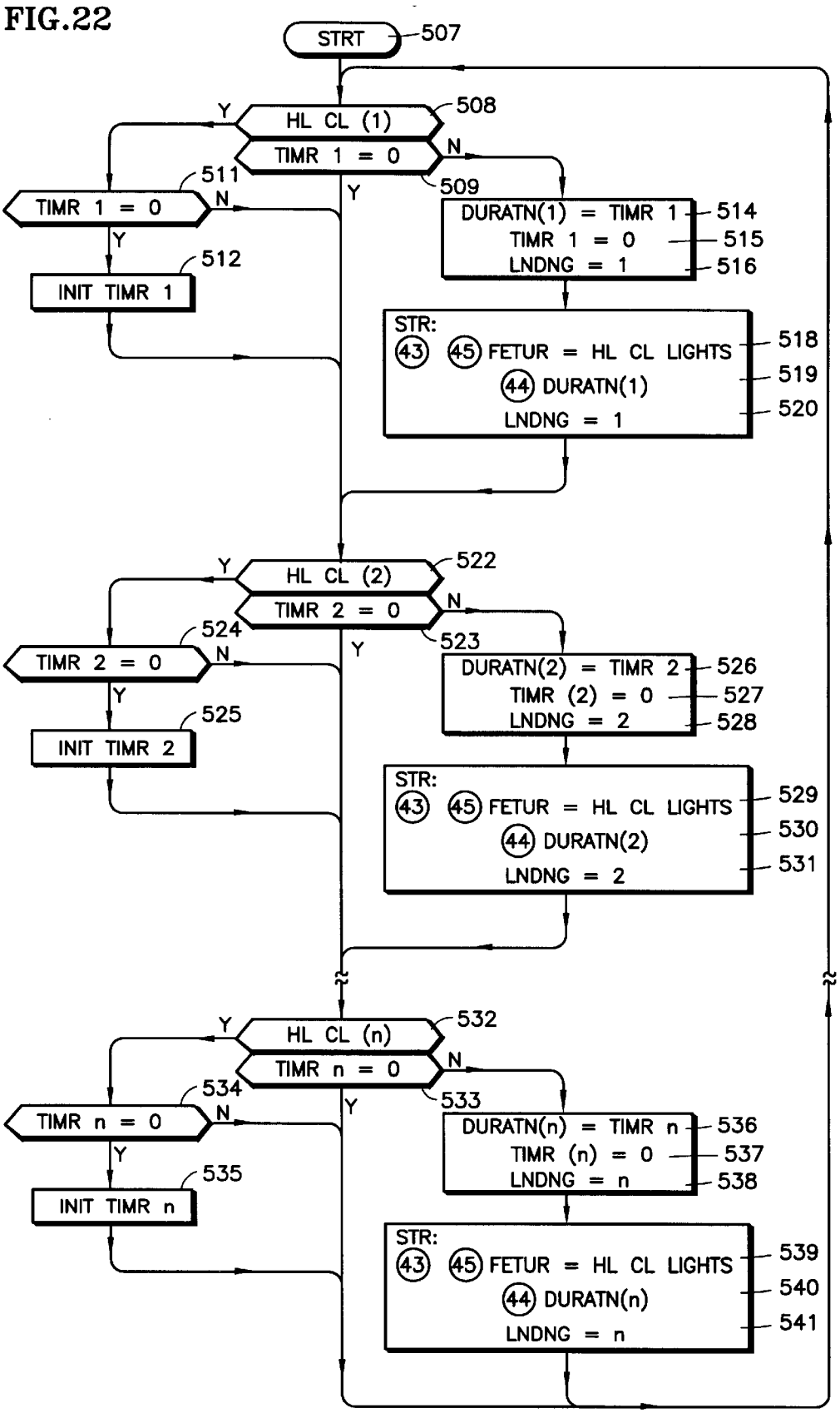
Figure 23:
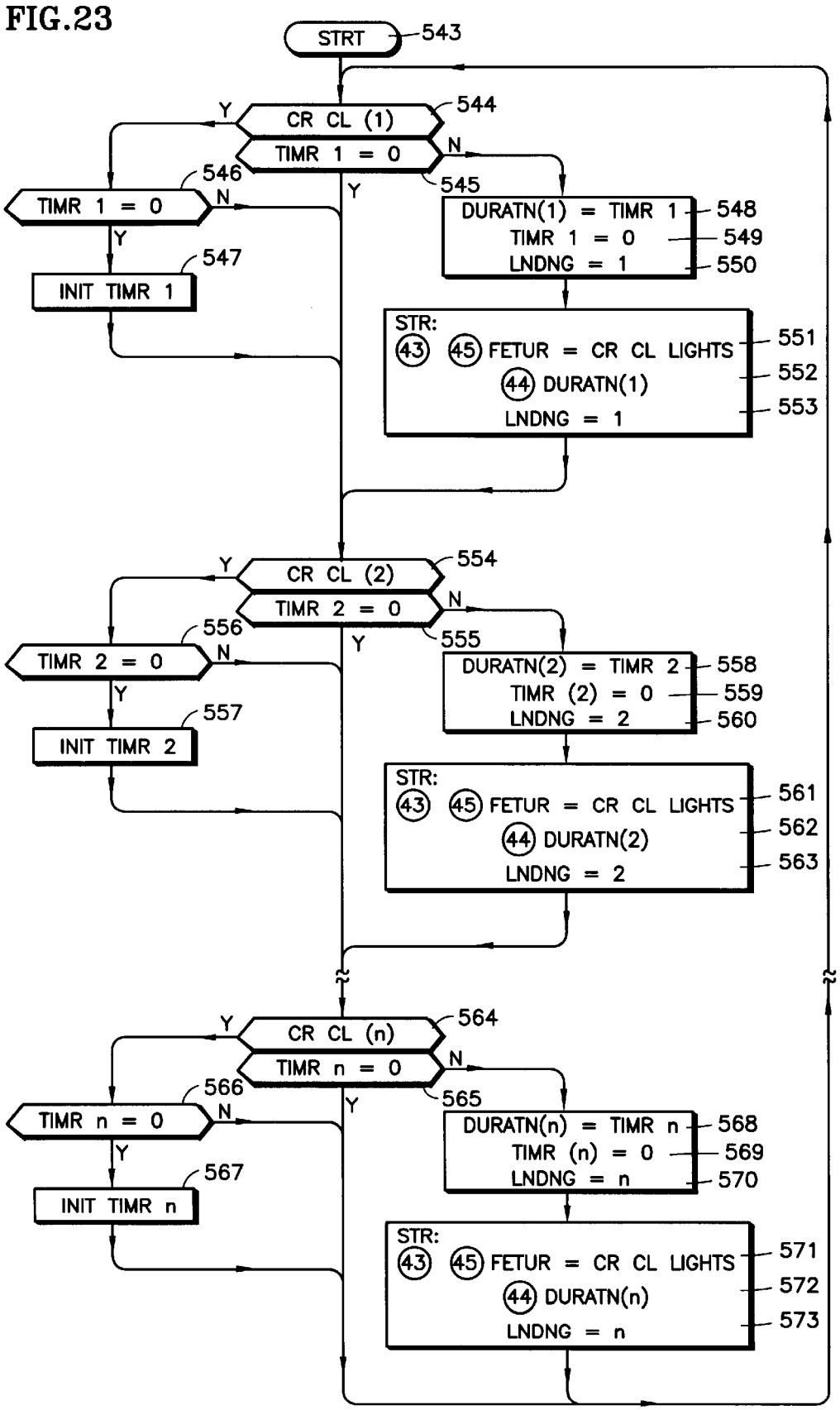

In FIG. 22, a routine for determining the occurrence and duration of hall call (landing call) button lights being lit is reached through a start entry point 507 and a first test determines if a hall call is registered for the first landing 508. If not, a test 509 determines if a timer has already been set, or if it still equals zero. If it still equals zero, then the routine advances to a test 522 related to the hall call for the second landing. However, if a hall call is registered for the first landing, then a test 511 determines whether the timer has been initiated or not. If it has not, it will still be set to zero so an affirmative result of test 511 reaches a step 512 to initiate timer 1, which will time the hall call signal on the first landing. Then the program advances to the next test 522 relating to the second landing. Then the program will deal with hall calls on all of the landings, after which it reverts to the test 508. If the hall call is still registered, then test 511 will be reached, but this time it will be negative since the timer was initiated and no longer is resting on zero. The routine will once again pass through tests for hall calls on each of the landings and again revert to the test 508. Assuming now that the hall call has terminated, a negative result of test 508 reaches step 509 which this time is negative, thereby reaching steps 514–516 to set the duration for landing one equal to timer 1, to reset timer one to zero so it will be ready for a subsequent operation of the hall call button, and to set the landing (related to this feature) equal to 1. Then, a step 518 will store Parameter Nos. 43 and 45 (because these parameters relate both to hall call lights and car call lights), which is a feature called hall call lights. A step 519 stores Parameter No. 44, the duration of the hall call at the first landing, and a step 520 stores the landing number established in step 516. And then the routine reaches the step 522 to make similar tests and perform similar steps. Since the remainder of FIG. 22 operates as described with respect to steps and tests 508–520, further description is not required. Similarly, FIG. 23, relating to car calls, operates in a fashion identical to FIG. 22 and further description is not required.

Figure 24:
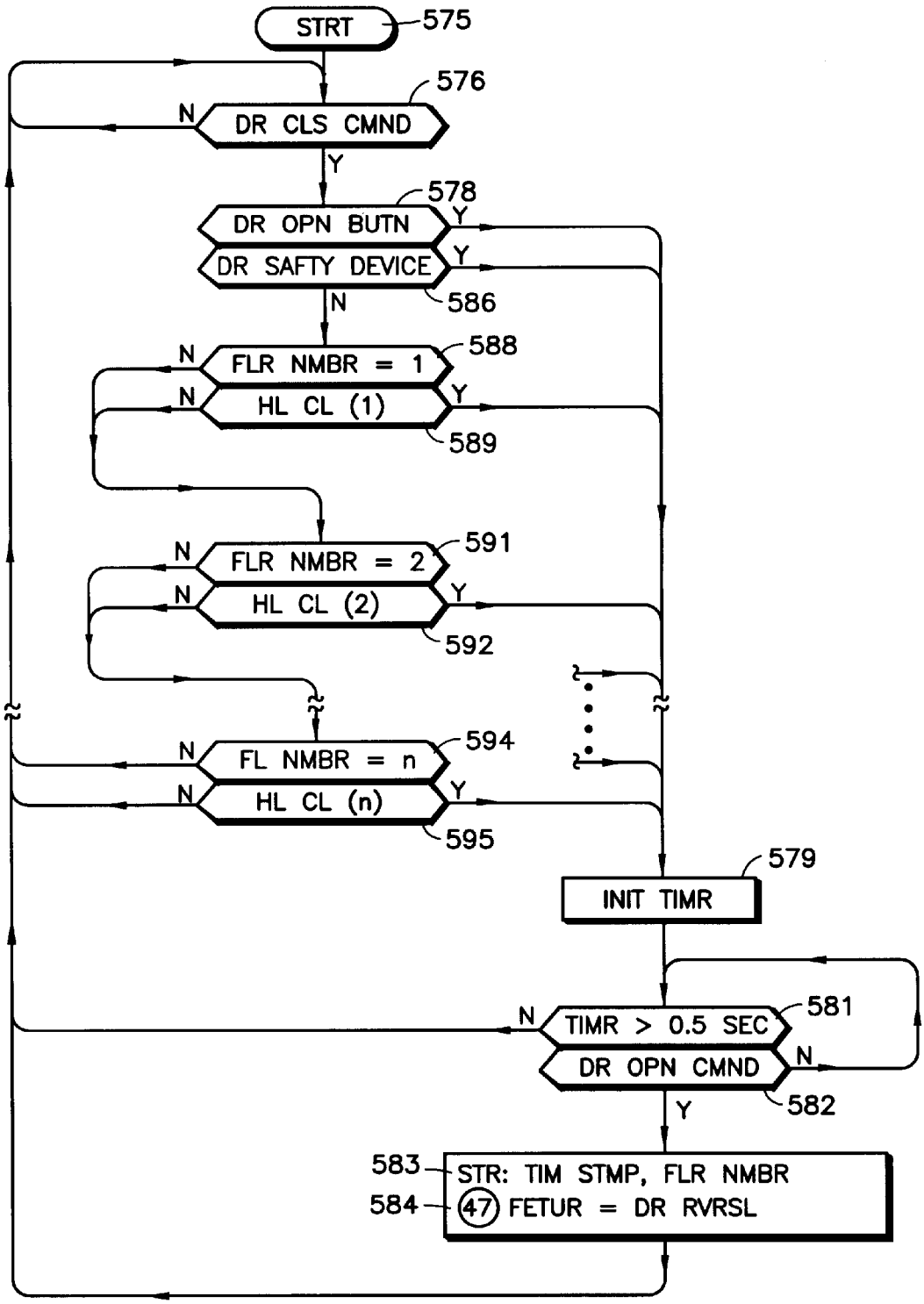

A routine which detects door reversals is reached in FIG. 24 through a start entry point 575, and the routine waits at a test 576 until there is a door close command, because door reversals only occur when the door is closing. Then a test 578 determines if the door open button has been pressed. If so, a step 579 initiates a timer and then the routine loops through tests 581 and 582 until either the timer exceeds one-half second, or there is a door open command. If there is no door open command within one-half second, this means that, despite pressing the door open button, a door reversal will not occur. This circumstance can happen when the door is in a nudging mode, in which the door is being forcibly closed at a very low speed. In the usual case, pressing the door open button, activation of a between-door safety device, or pressing a landing call (hall call) button, will result in a door open command to effect a door reversal. This will come well within one-half second so that an affirmative result of test 582 will reach a pair of steps 583 which store the time stamp and floor number and Parameter No. 47, a feature called "door reversal". If the door open button has not been pressed, a test 586 determines if the between-door safety device has been activated; if so, the routine is as described hereinbefore; if not, hall call buttons and elevator floor positions are tested in tests 588–595 to see if the door should be reversed due to a hall call; if so, the routine is as described hereinbefore.

Figure 25:
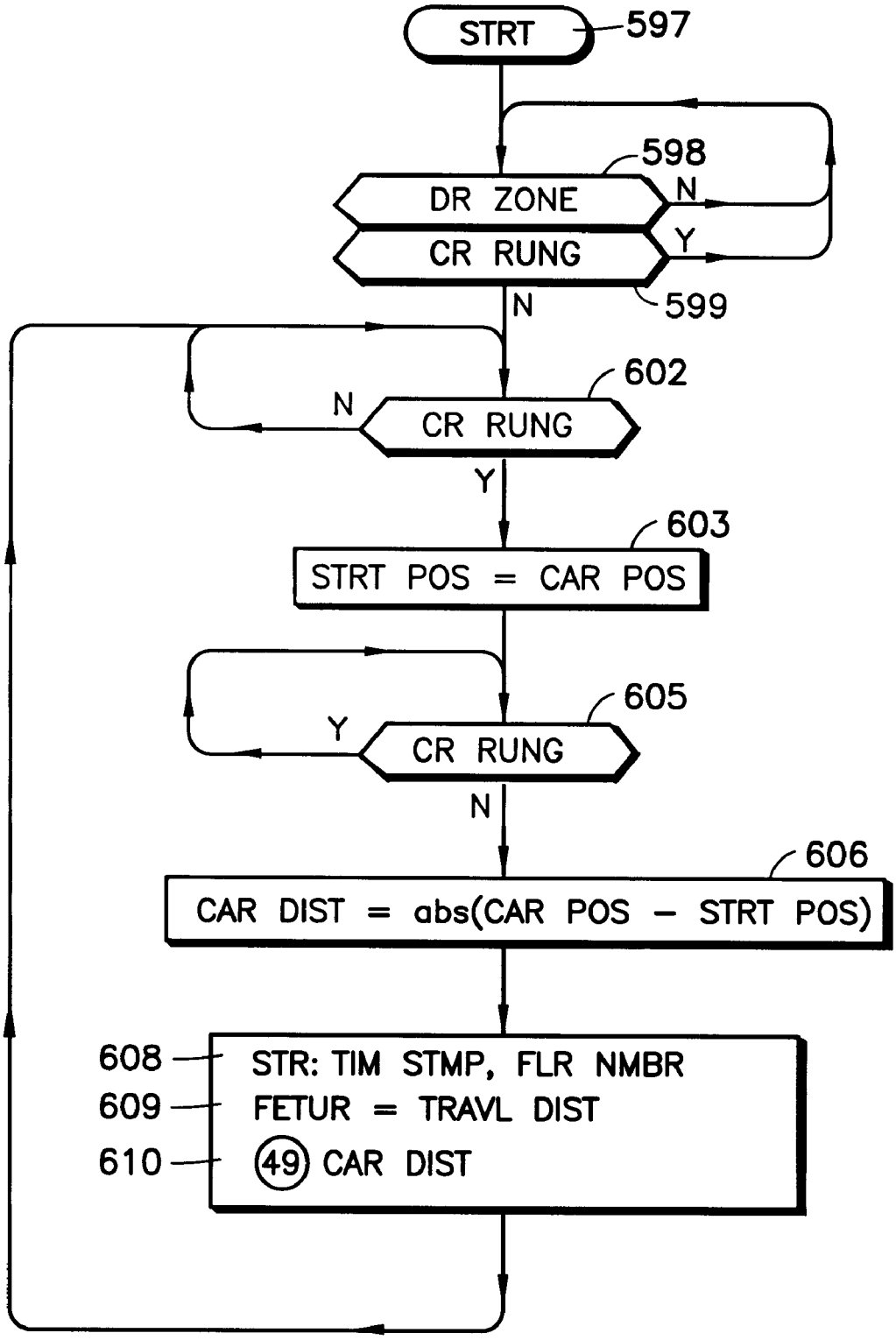

The routine in FIG. 25 accumulates the total distance which the elevator car has traveled. The routine is reached through a start entry point 597 and then waits at tests 598 and 599 until the car is within a door zone with the car not running, that is, with the car stopped. Then it waits at a test 602 until the car runs again, and a step 603 sets a start position equal to the present car position; then the routine waits at a test 605 until the car is stopped once again. Then a step 606 sets the car distance equal to the absolute value of the present car position minus the start position. A series of steps 608–610 store the time stamp and floor number, a feature called "travel distance" and Parameter No. 49, car distance. Then the routine reverts to the step 602 to wait until the car runs once again.

The invention is in auditing the elevator to provide maintenance messages, and then providing maintenance indicated by those messages. The features, parameters and attributes, such as values related to the parameters and features, are processed to determine the propriety of any given maintenance message, utilizing logical processing which is within the skill of the art in the light of the teachings herein. This is described, with respect to each maintenance message, in the following paragraphs (C) through (YY).

(C) A first maintenance message which the invention provides is one which directs that the position of the car door vane be adjusted. This message is generated in response to any of the following conditions: (a) the average of the position of the car door when the landing door lock switch opens (Parameter No. 1, FIG. 1) being greater than one threshold or less than another threshold, for a number of different landings which exceeds a predetermined fraction of the landings in the building, such as 40% of the landings; or (b) the fraction of times that the landing door is closed at a given landing (Parameter No. 3, FIG. 2) in which the landing door lock switch does not close (Parameter No. 2, FIG. 2), which is the feature called "landing door lock switch fail" in FIG. 2, exceeding a predetermined threshold, for a number of landings exceeding a predetermined fraction of landings, such as 40%; or (c) the fraction of times that the landing door opens at a landing (Parameter No. 3, FIG. 2) without a door open command (Parameter No. 4, FIG. 2, a feature called "landing door lock switch open without command") to the total number of times that the landing door opens at said landing, exceeding a related threshold for more than a predetermined fraction of the landings, such as 40%; or (d) the ratio of number of times that the landing door lock switch is closed when the landing door is open (Parameter No. 5, FIG. 1, a feature called "landing door lock switch bypassed") to the number of times that the landing door is open at a given landing, exceeding a related threshold for an excessive number of landings (such as 40% or more).

(D) Another maintenance message is to adjust the position of the landing door lock at any given floor. This message may be generated whenever: (a) the position of the car door as the landing door lock switch opens (Parameter No. 1, FIG. 1) is greater or less than respectively corresponding thresholds, when there is no contemporaneous maintenance message to adjust the position of the car door vane (paragraph (C), hereinbefore), or (b) the ratio of the number of times that the landing door lock switch does not close when the car door is closed (Parameter Nos. 2 and 3, FIG. 2) to the number of times that the landing door is closed at said given landing (Parameter No. 3, FIG. 2), exceeding a related threshold, or (c) the ratio of the number of times that the landing door lock switch opens without a door open command (Parameter No. 4, FIG. 2) at a given landing to the number of times that the landing door is open (Parameter No. 3, FIG. 2) at said landing when there is no contemporaneous maintenance message to adjust the position of the car door vane (paragraph (C), hereinbefore), exceeding a related threshold.

(E) A maintenance message to either adjust or clean the landing door lock at a given floor may be generated in response to (a) the ratio of the number of times the landing door lock switch rebounds at a floor (Parameter No. 6, FIG. 3) which occur with the speed of the car door as the landing door lock closes (Parameter No. 7, FIG. 3) in excess of a related threshold, to the number of times the landing door closes at said floor, when there is no contemporaneous maintenance message to adjust the position of the car door vane (paragraph (C), hereinbefore), being less than a related threshold, or (b) the total number of landing door operations (Parameter No. 8, not shown) at said given landing being less than a related threshold, or (c) the ratio of the number of landing door lock switch rebounds (Parameter No. 6, FIG. 3) at a given landing which occur with the speed of the car door as the landing door lock switch closed (Parameter No. 7, FIG. 3) below a related threshold, to the total number of times the landing door is closed at said landing (Parameter No. 3, FIG. 2), exceeding a related rebound threshold, or (d)

the total number of landing door lock switch rebounds (Parameter No. 6, FIG. 3) exceeding a related threshold; or (e) the ratio of the number of times that the landing door lock switch is closed when the landing door is open (Parameter No. 5, FIG. 1) to the number of times the landing door is open (Parameter No. 3, FIG. 2) at a given landing, exceeding a related threshold for a small number of landings (such as less than 40% of the landings).

(F) A maintenance message directing that the car door closed switch be cleaned or adjusted may be generated in response to: (G) the ratio of the number of times that the car door closed switch is not closed when the car door is fully closed (Parameter Nos. 9 and 10, FIG. 5, a feature called "car door switch failure") to the number of car door operations (Parameter No. 11, not shown) exceeds a related threshold; or (H) the number of times that the car door closed switch is closed when the car door is not fully closed (Parameter No. 5, FIG. 1) to the number of car door operations (Parameter No. 11) exceeds a related threshold; or (I, J) when the car is either moving or at a landing (Parameter No. 15, FIG. 6) with the door fully closed (Parameter No. 10, not shown), the ratio of the number of times that the car door closed switch opens (Parameter No. 9) when there has been no door open command (Parameter No. 12, which combine to form Parameter No. 35, FIG. 5) to the number of door operations in response to a door open command, exceeds a related threshold; or (K) the position of the car door when the car door closed switch becomes closed (Parameter No. 13, FIG. 4) is more than a related threshold from the door closed position (Parameter No. 14, FIG. 4); or (L) the number of car door operations (Parameter No. 11) exceeds a related threshold.

(M, N) Maintenance messages to perform adjustment or cleaning of the car door track or the car door sill, or to perform adjustment or cleaning of the landing door track or the landing door sill, the choice depending on whether the various notable conditions occur at less than some fraction of the total number of landings, such as 40%, or the number of a landing door's operations being excessive, in which case the problem relates to a landing door track or landing door sill problem, or the various notable conditions occur at more than some fraction of all the landings, such as 40%, or the number of car door operations being excessive, in which case the problem relates to the car door track and the car door sill. The parameters for these tests are: the frequency of the car door not opening fully with final opening speed more than a related threshold (Parameter No. 16 which is a combination of Parameter Nos. 24 and 25, FIG. 15); the frequency of the car door not closing fully when closing with a final closing speed more than a related threshold (Parameter No. 17 which is a combination of Parameter Nos. 28 and 30, FIG. 15); the average time required to open the car door (Parameter No. 18, FIG. 7) at a constant low door motor current (Parameter No. 31, FIG. 7) being too great; the average time required to close the car door (Parameter No. 19, FIG. 8) at a constant low door motor current (Parameter No. 31, FIG. 8) being too great; the amount the car door moves in the closing direction after car door motor current ceases when the car door has been opened (Parameter No. 20, FIG. 9) exceeding a threshold; the amount the car door moves in the opening direction after car door motor current ceases when the car door has been closed (Parameter No. 21, FIG. 9) exceeding a threshold; or the frequency of an impediment slowing the car door while opening (Parameter No. 22, FIGS. 11 and 12) or closing (Parameter No. 23, FIG. 14) exceeding a respective threshold;

(O) A maintenance message to adjust the flexible traction loop (such as a belt) that drives the car door is generated (P) if the average position of the car door when it stops after opening slowly (Parameter No. 24, FIG. 15), in response to constant door motor with the landing door disengaged, exceeds a related threshold; or, (Q) if the number of car door operations (Parameter No. 11) over a period of time exceeds a related threshold.

(R) A maintenance message to adjust the elevator car door motor or the related door controller mechanism is generated if: (S) the ratio of (a) the number of times that the position of the car door when it stops after opening (Parameter No. 24, FIG. 15), is less than a related threshold, with the final opening speed (Parameter No. 25, FIG. 15) more than a related threshold, at any given landing, to (b) the number of times the door opens (Parameter No. 27, not shown) at said landing, exceeds a related threshold for an excessive number of landings; or (T) the ratio of an excessively high door unlocking speed (Parameter No. 26, FIG. 1) with the car door lock in a proper range of position (Parameter No. 1, FIG. 1) at any landing to the number of door operations at that landing (Parameter No. 27), exceeds a related threshold; or (U, V) the ratio of (a) number of times that the speed of the car door when the landing door lock switch becomes open (Parameter No. 26, FIG. 1), being too high or too low, with the landing door lock opening position (Parameter No. 1, FIG. 1) being within a range of positions to (b) the number of times the car door opens (Parameter No. 27), exceeds a respective threshold; or (W) the ratio of (a) the number of times that the position of the car door when it stops after closing (Parameter No. 28, FIG. 15) exceeds a related threshold when the speed of the car door just before the car door stops after closing (Parameter No. 30, FIG. 15) is more than a related threshold, to (b) the number of times the door closes (Parameter No. 29) at the given landing, exceeds a related threshold for an excessive number of landings; or (X, Y) the ratio of (a) the number of times that the speed of the car door when the landing door lock switch closes (Parameter No. 7, FIG. 3) is respectively too high or too low to (b) the number of times the car door closes (Parameter No. 29) at said given landing, exceeds a related threshold; or (Z) the ratio of (a) the number of times that the speed of the car door just before the car door stops after closing (Parameter No. 30, FIG. 15) is excessive when the car is at a given landing to (b) the number of times the car door closes (Parameter No. 29) at said given landing, exceeds a related threshold for an excessive number of landings; or (AA) the variation of the time it takes for the door to open (Parameter No. 32, FIG. 7) when in a normal operation mode (Parameter No. 31, FIG. 7), exceeds a related threshold while the car is at a given landing, for an excessive number of landings; or (BB) the variation of the time it takes for the door to close (Parameter No. 33, FIG. 8) when in a normal operation mode (Parameter No. 31, FIG. 8), exceeds a related threshold, while the car is at a given landing, for an excessive number of landings; or (CC) the ratio of (a) the number of times that the position reached by the car door (Parameter No. 34, FIG. 6) after it opens without a command (Parameter No. 35, FIG. 6) exceeds a threshold to (b) the total number of occurrences of the car door closed switch opening without a door open command (Parameter No. 35, FIG. 6) exceeds a threshold.

(DD) A maintenance message to adjust or replace the door position encoder is generated in response to either: (EE) the ratio of (a) the number of times that the position at which the car door leaves a door closed position sensor is at variance with a true door closed position (Parameter Nos. 36 and 37, FIG. 10, which form the feature called "car door position error") by more than a threshold amount to (b) the number of car door operations (Parameter No. 11), exceeding a related threshold; or (FF) the total number of car door operations (Parameter No. 11) exceeding a related threshold.

(GG) A maintenance message to adjust or replace the between-door safety device is generated in response to either: (HH) the ratio of (a) the number of operations of a between-door safety device (Parameter No. 38, FIG. 17, a feature called "door safety device") when the car door has been parked with the doors closed for a corresponding period of time (Parameter No. 39, FIG. 16) to (b) the number of runs made by the elevator car (Parameter No. 40, not shown), exceeds a related threshold; or (II) the ratio of (a) the number of operations of the between-door safety device (Parameter No. 38, FIG. 17) when the car is not now in a condition of having been parked with the doors closed for a corresponding period of time (Parameter No. 39, FIG. 16) to (b) the number of stops at each landing (Parameter No. 41) being less than a related threshold for an excessive number of landings; or (JJ) the average duration of operation of a between-door safety device (Parameter No. 42, FIG. 17) exceeding a between-door safety device threshold; or (KK) the total number of operations of the between-door safety device (Parameter No. 38, FIG. 17) exceeding a related threshold.

(LL) A maintenance message to adjust or replace button switches selected from a door open button, a door closed button, hall call buttons and car call buttons, respectively, is generated if: (MM) the ratio of the number of operations of one of the call button switches (Parameter No. 43, FIGS. 20 and 21) to the number of stops at a corresponding landing (Parameter No. 41) is below a respectively corresponding threshold; or (NN) the operation of a door open or of a door closed button, respectively, (Parameter No. 43, FIGS. 18 and 19) when the car is not now in a condition of having been parked with the doors closed for a corresponding period of time (Parameter No. 39, FIG. 15) exceeds a respectively corresponding threshold; or (OO) the average duration of operation of one of said button switches (Parameter No. 45, FIGS. 18–23), over the last five or ten operations, exceeds a related threshold; or (PP) the total number of uses of one of said button switches (Parameter No. 45, FIGS. 18–23) exceeds a related threshold; or (QQ) there being no instances of the door open button being used (Parameter No. 46, FIG. 18) during a predetermined number of runs of the elevator car (Parameter No. 40) while door reversals (Parameter No. 47, FIG. 24) exceed a related threshold; or (RR) there being no instance of the door close button being used (Parameter No. 48, FIG. 19) for a related number of runs of the elevator car (Parameter No. 40).

(SS) A maintenance message to replace a related landing call button light or car call button light is generated if: (TT) the number of operations of each call button switch (Parameter No. 43, FIGS. 22, 23) per stop at the corresponding landing exceeds a corresponding call button light frequency threshold; or (UU) the duration of operation of any call button switch (Parameter No. 44, FIGS. 22, 23) exceeds a call button light duration threshold; or (VV) the total number of uses of a call button switch (Parameter No. 45, FIGS. 22, 23) exceeds a corresponding button light useful threshold.

(WW) A maintenance message (XX) to adjust or replace the car rail guides is generated if (a) the variation in the position of the car door when the landing door lock switch opens (Parameter No. 1, FIG. 1) exceeds a related threshold for an excessive number of landings (such as over 30%), or (b) the total distance that the elevator car has traveled (Parameter No. 49, FIG. 25) exceeds a related threshold.

(YY) A maintenance message to adjust the side-to-side clearance of the car guide rails at any given landing is generated if the variance in the position of the car door when the landing door lock switch opens (Parameter No. 1, FIG. 1) exceeds a related threshold at any given landing, for a number of landings less than a related fraction (such as 30%) of said landings.

The aforementioned patent application is incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of maintaining an elevator system serving a plurality of landings and having (a) a landing door which can be engaged by a corresponding car door to be opened thereby with (i) a landing door lock, (ii) a door lock switch, (iii) a track and a sill, (b) a car door with (i) a car door lock, (ii) a door closed switch, (iii) a door closed position sensor, (iv) a related door motor and (v) a door controller mechanism driving said car door through (vi) a flexible traction loop, (vii) a door position encoder, (viii) a track and a sill, (ix) a between-door safety device, and (x) a door vane interacting with rollers or guides to move a landing door in response to movement of the car door, (c) button components including call buttons selected from car call and landing call button switches with lights, and door buttons selected from door open and close button switches, (d) car guide rails, (e) a car juxtaposition with said rails by (f) car rail guides, which method comprises:

(A) monitoring at every landing as each is served by the elevator system, over one or more predetermined measurement spans, parameters corresponding to steps and/or conditions (C) through (UU) selected from (1) the position of the car door when a landing door lock switch opens, (2) a landing door lock switch not closing, (3) a landing door being closed or not, (4) a landing door lock switch opening without a door open command, (5) a landing door lock switch being closed when a landing door is open, (6) number of times that a landing door lock rebounds into an open position after closing, (7) the speed of the car door when a landing door lock switch closes, (8) the number of landing door operations for each landing, (9) the car door closed switch being open or closed; (10) the car door being fully closed, or not, (11) the number of car door operations, (12) a door open command, (13) the position of the car door when the car door closed switch becomes closed, (14) the car door closed position, (15) whether the car is at a landing or moving, (16) frequency of car door not opening fully with final opening speed more than a related threshold, (17) frequency of car door not closing fully with final closing speed more than a related threshold, (18) average time required to open car door at constant low door motor current, (19) average time required to close the car door with constant low door motor current, (20) amount the car door moves in the closing direction after car door motor current ceases when car door has been opened, (21) amount the car door moves in the opening direction after car door motor current ceases when car door has been closed, (22) frequency of an impediment slowing the car door while opening, (23) frequency of an impediment slowing the car door while closing, (24) position of the car door when it stops after opening, (25) the speed of the car door just before it stops after opening, (26) the speed of the car door when a landing door lock switch becomes open, (27) the car door opening, (28) position of the car door when it stops after closing, (29) the car door closing, (30) the speed of the car door just before the car door stops after closing, (31) the mode of operation of the car door, (32) time it takes for the door to open, (33) time it takes for the door to close, (34) a position reached by the car door after it opens without command, (35) the car door closed switch opening without a door open command, (36) the car door leaving a door closed position sensor as it opens, (37) a true car door closed position, (38) operation of a between-door safety device, (39) the car having been parked with the doors closed for a corresponding period of time, (40) runs made by the elevator car, (41) stops at each landing, (42) duration of each operation of a between-door safety device, (43) operation of each one of said button switches, (44) the duration of operation of each one of said button switches, (45) the total number of uses of each one of said button switches, (46) the door open button being used or not, (47) door reversals, (48) the door closed button being used or not, and (49) the total distance that the elevator car has traveled; the parameters (2)–(6), (8), (12), (14), (16)–(23), (28), (32), (33), (38), (41), (43)–(45), and (47) being monitored separately for each landing;

(B) performing a maintenance operation on said elevator system in response to a maintenance message generated in any of the following steps (C) through (F), (M) through (O), (R), (DD), (GG), (LL), or (WW);

(C) determining the occurrence of at least one of (a) the average of the parameter (1) position when the elevator car is at any given landing, being either (i) greater than a predetermined maximum average position threshold or (ii) less than a predetermined minimum average position threshold, for a number of different landings which exceeds a first predetermined fraction of said landings, (b) the ratio of (i) the number of times that the parameter (2) landing door lock switch not closing when the parameter (3) landing door is closed at a given landing to (ii) the number of times that the parameter (3) landing door is closed at said given landing, exceeding a predetermined first non-closure threshold, for a number of different landings which exceeds a second predetermined fraction of said landings, (c) the ratio of (i) the number of times that the parameter (4) landing door lock switch opens without command at a given landing to (ii) the number of times that the parameter (3) landing door is open at said given landing, exceeding a predetermined first uncommanded opening threshold, for a number of different landings which exceeds a third predetermined fraction of said landings, and (d) the ratio of (i) the number of times that the parameter (5) landing door lock switch being closed when the landing door is open at a given landing to (ii) the number of times that the parameter (3) landing door is open at said given landing, exceeding a predetermined switch bypassed threshold, for a number of different landings which exceeds a fourth predetermined fraction of said landings, and in response thereto, generating a maintenance message to adjust the position of the car door vane;

(D) determining the occurrence of at least one of (a) the average of the parameter (1) position when the elevator car is at any given landing being either (i) greater than said maximum average position threshold for a number of different landings which is less than a fifth predetermined fraction of said landings, or (ii) less than a minimum average position threshold when said step (C) maintenance message is not being generated, (b) the ratio of (i) the number of times that the parameter (2) landing door lock switch does not close when the parameter (3) landing door is closed at a given landing to (ii) the number of times that the parameter (3) landing door is closed at said given landing, exceeding a predetermined second non-closure threshold, and (c) the ratio of (i) the number of times that the parameter (4) landing door lock switch opens without a door open command at a given landing to (ii) the number of times that the parameter (3) landing door is open at said given landing, when said step (C) maintenance message is not being generated, exceeding a predetermined second uncommanded opening threshold, and in response thereto, generating a maintenance message to adjust the position of the landing door lock at said given floor;

(E) determining the occurrence of at least one of (a) the ratio of (i) the number of said parameter (6) landing door lock rebounds at a given floor to (ii) the number of occurrences of the parameter (3) landing door is closed at said given floor, which occur with the parameter (7) speed in excess of a high speed threshold, when said step (C) maintenance message is not being generated, is below a predetermined high speed rebound threshold, (b) the parameter (8) number of landing door operations at a given landing exceeding a predetermined total door operation threshold, (c) the ratio of (i) the number of said parameter (6) landing door lock rebounds at a given landing to (ii) the number of the parameter (3) landing door is closed at said given landing, which occur with the parameter (7) speed below a low speed threshold, exceeding a predetermined low speed rebound threshold, (d) the total number of the parameter (6) landing door lock rebounds at a given landing exceeding a total rebound threshold, and (e) the ratio of (i) the number of times that the parameter (5) landing door closed switch being closed when the landing door is open at a given landing to (ii) the number of times that the parameter (3) landing door is open at said given landing, exceeding a predetermined switch bypassed threshold, for a number of different landings which is less than a sixth predetermined fraction of said landings, and in response thereto, generating a maintenance message to either (i) adjust or (ii) clean the landing door lock at said given floor;

(F) generating a maintenance message to perform at least one of (i) cleaning or (ii) adjusting the car door closed switch in response to at least one of the following conditions (G) through (L):

(G) said parameters (9)–(11) are monitored and the ratio of (a) the number of times that (i) the parameter (9) car door closed switch is not closed when (ii) the parameter (10) car door is fully closed to (b) (iii) the parameter (11) number of car door operations when (iv) the parameter (9) car door closed switch is closed, exceeds a predetermined car door closed switch failure frequency threshold;

(H) said parameters (9)–(11) are monitored and the ratio of (a) the number of times that (i) the parameter (9) car door closed switch is closed when (ii) the parameter (10) car door is not fully closed to (b) the parameter (11) number of car door operations, exceeds a predetermined car door switch bypassed frequency threshold;

(I) said parameters (9–12 and 15) are monitored whenever the parameter (15) car is at a landing, with the parameter (10) car door being fully closed, and the ratio of (a) (i) the parameter (9) car door closed switch being open when (ii) there has been no parameter (12) door open command to (b) (iii) the parameter (11) number of car door operations in response to (iv) the parameter (12) door open command, exceeds a predetermined car door lock switch open at landing frequency threshold;

(J) said parameters (9–12 and 15) are monitored whenever the parameter (15) car is moving, with the parameter (10) door being fully closed and the ratio of (a) (i) the parameter (9) car door closed switch being open when (ii) there has been no parameter (12) door open command to (b) (iii) the parameter (11) number of car door operations in response to the (iv) parameter (12) door open command, exceeds a predetermined car door switch open in flight frequency threshold;

(K) said parameters (11), (13) and (14) are monitored and (a) said parameter (13) position of the car door when the car door closed switch becomes closed is less than a predetermined threshold distance from (b) said parameter (14) door closed position;

(L) said parameter (11) is monitored and exceeds a predetermined car door closed switch operation threshold;

(M) determining when any said monitored parameter (16)–(23) does not meet a respectively corresponding parameter threshold when the car is at a given landing, for a number of different landings which exceeds a seventh predetermined fraction of said landings, or said monitored parameter (11) has exceeded a corresponding threshold and, in response thereto, generating a maintenance message to perform at least one of (a) adjustment or (b) cleaning of (i) the car door track or (ii) the car door sill;

(N) determining when any said monitored parameter (16)–(20), (22) or (23) does not meet respectively corresponding parameter threshold when the car is at a given landing, for a number of different landings which is less than an eighth predetermined fraction of said landings, or said monitored parameter (8) has exceeded a corresponding threshold, and, in response thereto, generating a maintenance message to perform at least one of (a) adjustment or (b) cleaning of (i) the landing door track or (ii) the landing door sill at any said given landing;

(O) generating a maintenance message to adjust said flexible traction loop in response to at least one of the following steps (P), (Q):

(P) opening said car door at low speed with constant current to said motor and with said landing door disengaged from said car door, a number of times, each time recording the parameter (24) position of the car door when it stops after opening, and generating said maintenance message of said step (O) if the average of the positions recorded exceed a predetermined average open position threshold; and (Q) monitoring the parameter (11) number of car door operations over a predetermined measurement span, and generating said maintenance message of said step (O) if the number of car door operations exceeds a door operation threshold;

(R) generating a maintenance message to adjust at least one of (i) the elevator car door motor or (ii) the related door controller mechanism in response to at least one of the following conditions (S) through (CC):

(S) said parameters (24), (25) and (27) being monitored and the ratio of (a) the number of times that (i) the parameter (24) open position is less than (ii) a minimum door open position threshold after opening with (iii) the parameter (25) speed less than (iv) a low door unlocking speed threshold when the elevator car is at a given landing to (b) the number of occurrences of the parameter (27) door opening at said given landing, exceeding a low speed position frequency threshold, for a number of said landings which exceeds a ninth predetermined fraction of said landings;

(T) said parameters (1), (26) and (27) being monitored and the ratio of (a) the number of times that (i) the parameter (26) speed exceeds a high door unlocking speed threshold with (ii) the parameter (1) position being within a range of proper positions to (b) the number of occurrences of the parameter (27) door opening, at any landing, exceeding a maximum high door speed frequency threshold for a number of landings which exceeds a tenth predetermined fraction of said landings;

(U) said parameters (1), (26) and (27) being monitored and the ratio of (a) the number of times that (i) the parameter (26) speed exceeds a maximum door unlocking speed threshold at any landing with (ii) the parameter (1) landing door lock opening position being within a predetermined first range of positions to (b) the number of occurrences of the parameter (27) door opening at any landing, exceeding a first unlocking speed frequency threshold;

(V) said parameters (1), (26) and (27) being monitored and the ratio of (a) the number of times that (i) the parameter (26) speed is less than a minimum unlocking speed threshold at any landing with (ii) the parameter (1) landing door lock opening position being within a predetermined second range of positions to (b) the number of occurrences of the parameter (27) car door opening at any landing, exceeding a second unlocking speed frequency threshold;

(W) said parameters (28), (29) and (30) being monitored and the ratio of (a) the number of times that (i) the parameter (28) door close position exceeds a maximum door close position threshold after (ii) the door closes with said parameter (30) door closing speed being less than a maximum door closing speed threshold when the car is at a given landing, to (b) the number of occurrences of the parameter (29) door closing at said given landing, exceeding a low speed closing position frequency threshold, for a number of different landings which exceed an eleventh predetermined fraction of said landings;

(X) said parameters (7) and (29) being monitored and the ratio of (a) the number of times that the parameter (7) door switch closing speed exceeds a maximum lock closing speed threshold to (b) the number of occurrences of the parameter (29) door closing, exceeding a maximum high closing speed frequency threshold;

(Y) said parameters (7) and (29) being monitored and the ratio of (a) the number of times that the parameter (7) car door closing speed is less than a minimum lock closing speed threshold to (b) the number of occurrences of the parameter (29) door closing, exceeding a maximum low closing speed frequency threshold;

(Z) said parameters (29) and (30) being monitored and the ratio of (a) the number of times that the parameter (30) door closing speed exceeds a high door closing speed threshold when the car is at a given landing to (b) the number of occurrences of the parameter (29) door closing at said given landing, exceeding a high door closing speed frequency threshold, for a number of different landings which exceeds a twelfth predetermined fraction of said landings;

(AA) the parameters (31) and (32) being monitored and (i) the variation of the parameter (32) car door opening time, when (ii) in a parameter (31) normal operation mode, exceeding a maximum opening time variation threshold, while the car is at a given landing, for a number of different landings which exceeds a fourth percentage threshold;

(BB) the parameters (31) and (33) being monitored and (i) the variation of the parameter (33) car door closing time when in a parameter (31) normal operation mode, exceeding a maximum closing time variation threshold, while the car is at a given landing, for a number of different landings which exceeds a fifth percentage threshold;

(CC) the parameters (34) and (35) being monitored and the ratio of (a) the number of times that the parameter (34) position exceeds a maximum door open without command position threshold to (b) the total number of occurrences of the parameter (35) switch opening without command, exceeding a maximum position without command frequency threshold;

(DD) generating a maintenance message to perform at least one of (i) adjustment or (ii) replacement of the door position encoder in response to at least one of the following conditions (EE) and (FF):

(EE) the parameters (11) and (36) are monitored and the ratio of (a) the number of times that (i) the parameter (36) leaving a door closed position sensor occurs at a position at variance with (ii) the parameter (37) true door closed position by more than a position threshold to (b) the parameter (11) number of door operations, at any landing, exceeding a door position error frequency threshold;

(FF) the parameter (11) number of car door operations is monitored and exceeds an encoder operation threshold;

(GG) generating a maintenance message to either (i) adjust or (ii) replace the between-door safety device in response to at least one of the conditions (HH)–(KK):

(HH) the parameters (38)–(40) being monitored and the ratio of (a) the number of occurrences of (i) the parameter (38) between-door safety device operation when (ii) the parameter (39) car door state is present at any given landing to (b) the parameter (40) number of runs, exceeding a maximum safety device frequency threshold;

(II) the parameters (38), (39) and (41) being monitored and the ratio of (a) the number of occurrences of (i) the parameter (38) between-door safety device operation at any given landing concurrently with the parameter (39) car door state not being present, to (b) number of the parameter (41) stops at said given landing, being less than a minimum safety device frequency threshold, for a number of different landings which exceeds a thirteenth predetermined fraction of said landings;

(JJ) the parameter (42) duration being monitored and the average value of the parameter (42) duration exceeding a between-door safety device threshold;

(KK) the parameter (38) being monitored and the total number of the parameter (38) operations of a between-door safety device exceeding a total between-door safety device threshold;

(LL) generating a maintenance message to perform at least one of (i) adjustment or (ii) replacement of a related one of said button switches in response to a corresponding one of the following conditions (MM)–(RR):

(MM) the parameter (41) stops at each landing and the parameter (43) operation of each call button both being monitored and the ratio of calls per stop for any landing being below a corresponding upper call frequency threshold;

(NN) the parameter (40) runs by the elevator car and the parameter (43) operation of each door button during the absence of the parameter (39) being monitored and the ratio of door button operations per run for either door button exceeding a corresponding upper door button frequency threshold;

(OO) the parameter (44) duration of operation of a button switch being monitored over a last given number of operations, and the average thereof exceeding a corresponding duration threshold;

(PP) the parameter (45) total number of uses of a button switch being monitored and exceeding a corresponding button switch useful life threshold;

(QQ) the parameter (40) runs by the elevator car, the parameter (46) door open button use and the parameter (47) door reversals all being monitored and there being (i) no instances of parameter (46) use of door open button during a predetermined number of parameter (40) runs while (ii) the parameter (47) door reversals exceeds a door reversal threshold;

(RR) the parameter (40) runs by the elevator car and the parameter (48) door close button use both being monitored and there being no instance of parameter (48) use of door close button for a predetermined threshold number of parameter (40) runs;

(SS) generating a maintenance message to replace a related one of said call button lights in response to a corresponding one of the following conditions (TT)–(VV):

(TT) the parameter (41) stops at each landing and the parameter (43) operation of each call button switch being monitored and the ratio of calls per stop at any landing exceeding a corresponding call button light frequency threshold;

(UU) the parameter (44) duration of operation of a call button switch being monitored and exceeding a call button light duration threshold;

(VV) the parameter (45) total number of uses of each call button switch being monitored and one of them exceeding a corresponding button light useful threshold;

(WW) performing at least one of the following steps (XX) and (YY):

(XX) determining the occurrence of at least one of (a) the variation in the parameter (1) position at any given landing exceeding a first position variation threshold, for a number of different landings which exceeds a fourteenth predetermined fraction of said landings, and (b) the parameter (49) total distance exceeding a total distance threshold, and in response thereto generating a maintenance message to adjust or replace the car rail guides;

(YY) determining the occurrence of the variation in the parameter (1) position at any given landing exceeding a second position threshold, for a number of different landings which is less than a fifteenth predetermined fraction of said landings, and in response thereto generating a maintenance message to adjust the side-to-side clearance of said car guide rails at any said given landing.

2. A method of auditing the operation of an elevator system serving a plurality of landings and having a car and at least one of (i) a car door, (ii) a landing door with a door lock, and (iii) a door vane interacting with rollers or guides to cause a corresponding landing door to move in response to movement of said car door, which method comprises:

(A) monitoring at every landing as each is served by the elevator system, over one or more predetermined measurement spans, parameters corresponding to steps (C) through (E) selected from (1) the position of the car door when a landing door lock switch opens, (2) a landing door lock switch not closing, (3) a landing door being closed or not, (4) a landing door lock switch opening without a door open command, (5) a landing door lock switch being closed when the landing door is open, (6) number of times that a landing door lock rebounds into an open position after closing, (7) the speed of the car door when a landing door lock switch closes, and (8) the number of landing door operations for each landing; the parameters (1)–(6) and 8 being monitored separately for each landing; and (B) performing at least one of the following steps (C) through (E):

(C) determining the occurrence of at least one of (a) the average of the parameter (1) position when the elevator car is at any given landing, being either (i) greater than a predetermined maximum average position threshold or (ii) less than a predetermined minimum average position threshold, for a number of different landings which exceeds a first predetermined fraction of said landings, (b) the ratio of (i) the number of times that the parameter (2) landing door lock switch not closing when the parameter (3) landing door is closed at a given landing to (ii) the number of times that the parameter (3) landing door is closed at said given landing, exceeding a predetermined first non-closure threshold, for a number of different landings which exceeds a second predetermined fraction of said landings, (c) the ratio of (i) the number of times that the parameter (4) landing door lock switch opens without command at a given landing to (ii) the number of times that the parameter (3) landing door is open at said given landing, exceeding a predetermined first uncommanded opening threshold, for a number of different landings which exceeds a third predetermined fraction of said landings, and (d) the ratio of (i) the number of times that the parameter (5) landing door lock switch being closed when the landing door is open at a given landing to (ii) the number of times that the parameter (3) landing door is open at said given landing, exceeding a predetermined switch bypassed threshold, for a number of different landings which exceeds a fourth predetermined fraction of said landings, and in response thereto, generating a maintenance message to adjust the position of the door vane;

(D) determining the occurrence of at least one of (a) the average of the parameter (1) position when the elevator car is at any given landing being either (i) greater than said maximum average position threshold for a number of different landings which is less than a fifth predetermined fraction of said landings or (ii) less than a minimum average position threshold when said step (C) maintenance message is not being generated, (b) the ratio of (i) the number of times that the parameter (2) landing door lock switch does not close when the parameter (3) landing door is closed at a given landing to (ii) the number of times that the parameter (3) landing door is closed at said given landing, exceeding a predetermined second non-closure threshold, and (c) the ratio of (i) the number of times that the parameter (4) landing door lock switch opens without a door open command at a given landing to (ii) the number of times that the parameter (3) landing door is open at said given landing, when said step (C) maintenance message is not being generated, is below a predetermined second uncommanded opening threshold, and in response thereto, generating a maintenance message to adjust the position of the landing door lock at said given floor;

(E) determining the occurrence of at least one of (a) the ratio of (i) the number of said parameter (6) landing door lock rebounds at a given floor to (ii) the number of occurrences of the parameter (3) landing door is closed at said given floor, which occur with the parameter (7) speed in excess of a high speed threshold, when said step (C) maintenance message is not being generated, exceeding a predetermined high speed rebound threshold, (b) the parameter (8) number of landing door operations at a given landing exceeding a predetermined total door operation threshold, (c) the ratio of (i) the number of said parameter (6) landing door lock rebounds at a given landing to (ii) the number of the parameter (3) landing door is closed at said given landing, which occur with the parameter (7) speed below a low speed threshold, exceeding a predetermined low speed rebound threshold, (d) the total number of the parameter (6) landing door lock rebounds at a given landing exceeding a total rebound threshold, and (e) the ratio of (i) the number of times that the parameter (5) landing door closed switch being closed when the landing door is open at a given landing to (ii) the number of times that the parameter (3) landing door is open at said given landing, exceeding a predetermined switch bypassed threshold, for a number of different landings which is less than a sixth predetermined fraction of said landings, and in response thereto, generating a maintenance message to either (i) adjust or (ii) clean the landing door lock at said given floor.

3. A method of auditing the operation of an elevator system serving a plurality of landings and having (i) a car door with (ii) a car door closed switch, which method comprises:

(A) monitoring, over one or more predetermined measurement spans, parameters corresponding to conditions (C) through (I) selected from (1) the car door closed switch being open or closed; (2) the car door being fully closed, or not (3) the number of car door operations, (4) a door open command, (5) the position of the car door when the car door closed switch becomes closed, (6) the car door closed position, and (7) whether the car is at a landing or moving; the parameters (4) and (6) being monitored separately for each landing; and (B) generating a maintenance message to perform at least one of (i) cleaning or (ii) adjusting the car door closed switch in response to at least one of the following conditions (C) through (H):

(C) said parameters (1)–(3) are monitored and the ratio of (a) the number of times that (i) the parameter (1) car door closed switch is not closed when (ii) the parameter (2) car door is fully closed to (b) (iii) the parameter (3) number of car door operations when (iv) the parameter (1) car door closed switch is closed, exceeds a predetermined car door closed switch failure frequency threshold;

(D) said parameters (1)–(3) are monitored and the ratio of (a) the number of times that (i) the parameter (1) car door closed switch is closed when (ii) the parameter (2) car door is not fully closed to (b) the parameter (3) number of car door operations, exceeds a predetermined car door switch bypassed frequency threshold;

(E) said parameters (1)–(4) are monitored whenever the parameter (7) car is at a landing, with the parameter (2) car door being fully closed and the ratio of (a) (i) the parameter (1) car door closed switch being open when (ii) there has been no parameter (4) door open command to (b) (iii) the parameter (3) number of car door operations in response to (iv) the parameter (4) door open command, exceeds a predetermined car door lock switch open at landing frequency threshold;

(F) said parameters (1)–(4) are monitored whenever the parameter (7) car is moving, with the parameter (2) car door being fully closed and the ratio of (a) (i) the parameter (1) car door closed switch being open when (ii) there has been no parameter (4) door open command to (b) (iii) the parameter (3) number of car door operations in response to (iv) the parameter (4) door open command, exceeds a predetermined car door switch open in flight frequency threshold;

(G) said parameters (5) and (6) are monitored and (a) said parameter (5) position of the car door when the car door closed switch becomes closed is less than a predetermined threshold distance from (b) said parameter (6) car door closed position when said parameter (6) car door closed position is in excess of a related threshold;

(H) said parameter (3) is monitored and exceeds a predetermined car door closed switch operation threshold.

4. A method of auditing the operation of an elevator system serving a plurality of landings and having at least one component selected from (i) a car door track, (ii) a car door sill, (iii) a landing door track, and (iv) a landing door sill, which method comprises:

(A) monitoring at every landing as each is served by the elevator system, over one or more predetermined measurement spans, parameters corresponding to steps (B) and (C) selected from (1) frequency of car door not opening fully with final opening speed more than a related threshold, (2) frequency of car door not closing fully when closing with final closing speed more than a related threshold, (3) average time required to open car door at constant low door motor current, (4) average time required to close the car door at constant low door motor current, (5) amount the car door moves in the closing direction after car door motor current ceases when car door has been opened, (6) amount the car door moves in the opening direction after car door motor current ceases when car door has been closed, (7) frequency of an impediment slowing the car door while opening, (8) the frequency of an impediment slowing the car door while closing, (9) the number of car door operations, and (10) the number of landing door operations for each landing, the parameters (1)–(8) and (10) being monitored separately for each landing; and either:

(B) determining when any said monitored parameter (1)–(8) does not meet a respectively corresponding parameter threshold when the car is at a given landing, for a number of different landings which exceeds a first predetermined fraction of said landings, or said monitored parameter (9) has exceeded a corresponding threshold and, in response thereto, generating a maintenance message to perform at least one of (a) adjustment or (b) cleaning of (i) the car door track or (ii) the car door sill; or (C) determining when any said monitored parameter (1)–(5), (7) or (8) does not meet a respectively corresponding parameter threshold when the car is at a given landing, for a number of different landings which is less than a second predetermined fraction of said landings, or said monitored parameter (10) has exceeded a corresponding threshold, and, in response thereto, generating a maintenance message to perform at least one of (1) adjustment or (2) cleaning of (i) the landing door track or (ii) the landing door sill at any said given landing.

5. A method of auditing the operation of an elevator system serving a plurality of landings and having (i) at least one car door driven by a motor through a flexible traction loop and (ii) at least one landing door which can be engaged by a corresponding car door vane to be opened thereby, which method comprises:

(A) generating a maintenance message to adjust said flexible traction loop in response to at least one of the following steps (B), (C):

(B) opening said car door at low speed with constant current to said motor and with said landing door disengaged from said car door, a number of times, each time recording (1) the position of the car door when it stops after opening, and generating said maintenance message if the average of the positions recorded exceed a predetermined average open position threshold;

(C) monitoring (2) the number of car door operations over a predetermined measurement span, and generating said maintenance message if the number of car door operations exceeds a car door operation threshold.

6. A method of auditing the operation of an elevator system serving a plurality of landings and having (i) at least one elevator car door and (ii) related door motor and door controller mechanism, which method comprises:

(A) monitoring at every landing as each is served by the elevator system, over one or more predetermined measurement spans, parameters respectively corresponding to steps (C)–(M) selected from (1) the speed of the car door just before it stops after opening, (2) the speed of the car door when a landing door lock switch becomes open, (3) position of the car door when it stops after opening; (4) the car door opening, (5) the position of the car door when a landing door lock switch becomes open, (6) position of the car door when it stops after closing, (7) the car door closing, (8) the speed of the car door just before the car door stops after closing, (9) speed of the car door when a landing door lock switch closes, (10) the mode of operation of the car door, (11) time it takes for the car door to open, (12) time it takes for the car door to close, (13) a position reached by the car door after it opens without command, and (14) the car door closed switch opening without a door open command; the parameters (1), (6), (11) and (12) being monitored separately for each landing;

(B) generating a maintenance message to adjust at least one of (i) the elevator door motor or (ii) the related door controller mechanism in response to at least one of the following conditions (C) through (M):

(C) said parameters (1), (3) and (4) being monitored and the ratio of (a) the number of times that (i) the parameter (3) open position is less than (ii) a minimum door open position threshold after opening with (iii) the parameter (1) speed less than (iv) a low door unlocking speed threshold when the elevator car is at a given landing to (b) the number of occurrences of the parameter (4) door opening at said given landing, exceeding a low speed position frequency threshold, for a number of said landings which exceeds a first predetermined fraction of said landings;

(D) said parameters (2), (4) and (5) being monitored and the ratio of (a) the number of times that (i) the parameter (2) speed exceeds a high door unlocking speed threshold with (ii) the parameter (5) position being within a range of proper positions to (b) the number of occurrences of the parameter (4) door opening, at any landing, exceeding a maximum high door speed frequency threshold for a number of landings exceeding a second predetermined fraction of said landings;

(E) said parameters (2), (4) and (5) being monitored and the ratio of (a) the number of times that (i) the parameter (2) speed exceeds a maximum door unlocking speed threshold at any landing with (ii) the parameter (5) landing door lock opening position being within a predetermined first range of positions to (b) the number of occurrences of the parameter (4) door opening at any landing, exceeding a first unlocking speed frequency threshold;

(F) said parameters (2), (4) and (5) being monitored and the ratio of (a) the number of times that (i) the parameter (2) speed is less than a minimum unlocking speed threshold at any landing with (ii) the parameter (5) landing door lock opening position being within a predetermined second range of positions to (b) the number of occurrences of the parameter (4) car door opening at any landing, exceeding a second unlocking speed frequency threshold;

(G) said parameters (6), (7) and (8) being monitored and the ratio of (a) the number of times that (i) the parameter (7) door close position exceeds a maximum door close position threshold after (ii) the door closes with said parameter (8) door closing speed being less than a maximum door closing speed threshold when the car is at a given landing, to (b) the number of occurrences of the parameter (7) door closing at said given landing, exceeding a low speed closing position frequency threshold, for a number of different landings which exceed a third predetermined fraction of said landings;

(H) said parameters (7) and (9) being monitored and the ratio of (a) the number of times that the parameter (9) door switch closing speed exceeds a maximum lock closing speed threshold to (b) the number of occurrences of the parameter (7) door closing, exceeding a maximum high closing speed frequency threshold;

(I) said parameters (7) and (9) being monitored and the ratio of (a) the number of times that the parameter (9) door switch closing speed is less than a minimum lock closing speed threshold to (b) the number of occurrences of the parameter (7) door closing, exceeding a maximum low closing speed frequency threshold;

(J) said parameters (7) and (8) being monitored and the ratio of (a) the number of times that the parameter (8) door closing speed exceeds a high door closing speed threshold when the car is at a given landing to (b) the number of occurrences of the parameter (7) door closing at said given landing, exceeding a high door closing speed frequency threshold, for a number of different landings which exceeds a fourth predetermined fraction of said landings;

(K) the parameters (10) and (11) being monitored and (i) the variation of the parameter (11) car door opening time when (ii) in a parameter (10) normal operation mode, exceeding a maximum opening time variation threshold, while the car is at a given landing, for a number of different landings which exceeds a fourth percentage threshold;

(L) the parameters (10) and (12) being monitored and (i) the variation of the parameter (12) car door closing time when (ii) in a parameter (10) normal operation mode, exceeding a maximum closing time variation threshold, while the car is at a given landing, for a number of different landings which exceeds a fifth percentage threshold;

(M) the parameters (13) and (14) being monitored and the ratio of (a) the number of times that the parameter (13) position exceeds a maximum door open without command position threshold to (b) the total number of occurrences of the parameter (14) switch opening without command, exceeding a maximum position without command frequency threshold.

7. A method of auditing the operation of an elevator system serving a plurality of landings and having (i) a car door with (ii) a door position encoder and (iii) a door closed position sensor, which method comprises:

(A) monitoring at every landing as each is served by the elevator system, over one or more predetermined measurement spans, parameters corresponding to conditions (C) and (D) selected from (1) the car door leaving a door closed position sensor as it opens, (2) a true car door closed position, and (3) the number of car door operations;

(B) generating a maintenance message to perform at least one of (i) adjustment or (ii) replacement of the door position encoder in response to at least one of the following conditions (C) and (D):

(C) the parameters (1) and (3) are monitored and the ratio of (a) the number of times that (i) the parameter (1) leaving a door closed position sensor occurs at a position at variance with (ii) the parameter (2) true door closed position by more than a position threshold to (b) the parameter (3) number of car door operations, at any landing, exceeding a door position error frequency threshold;

(D) the parameter (3) number of car door operations is monitored and exceeds an encoder operation threshold.

8. A method of auditing the operation of an elevator system serving a plurality of landings and having a between-door safety device, which method comprises:

(A) monitoring at every landing as each is served by the elevator system, over one or more predetermined measurement spans, parameters corresponding to conditions (C)–(F) selected from (1) operation of a between-door safety device, (2) the car having been parked with the doors closed for a corresponding period of time, (3) runs made by the elevator car, (4) stops at each landing, monitored separately for each landing, and (5) duration of each operation of a between-door safety device;

(B) generating a maintenance message to either (i) adjust or (ii) replace the between-door safety device in response to at least one of the conditions (C)–(F):

(C) the parameters (1)–(3) being monitored and the ratio of (a) the number of occurrences of (i) the parameter (1) between-door safety device operation when (ii) the parameter (2) car door state is present, at any given landing to (b) the number of parameter (3) runs, exceeding a maximum safety device frequency threshold;

(D) the parameters (1), (2) and (4) being monitored and the ratio of (a) the number of occurrences of (i) the parameter (1) between-door safety device operation at any given landing concurrently with the parameter (2) car door state not being present to (b) the number of parameter (4) stops at said given landing, being less than a minimum safety device frequency threshold, for a number of different landings which exceeds a predetermined fraction of said landings;

(E) the parameter (5) duration being monitored and the average value of the parameter (5) duration exceeding a between-door safety device threshold;

(F) the parameter (1) being monitored and the total number of the parameter (1) operations of a between-door safety device exceeding a total safety device threshold.

9. A method of auditing the operation of an elevator system serving a plurality of landings and having a door and button components selected from at least one of (1) button switches of (a) door buttons including a (i) door open button and a (ii) door close button, and (b) call buttons including (iii) car call buttons and (iv) landing call buttons, and (2) corresponding call button switch lights, which method comprises:

(A) monitoring, at every landing as each is served by the elevator system, parameters corresponding to steps (C)–(I) selected from (1) the frequency of operation of one of said button components, (2) the duration of operation of one of said button components, (3) the total number of uses of one of said button components, (4) the door open button being used or not, (5) door reversals, (6) the door closed button being used or not, and (7) the car having been parked with the doors closed for a corresponding period of time; and (B) generating a maintenance message to perform at least one of (i) adjustment or (ii) replacement of a related one of said button switches in response to a corresponding one of the following conditions (C)–(L):

(C) the parameter (41) stops at each landing and the parameter (43) operation of each call button both being monitored and the ratio of calls per stop for any landing being less than a corresponding upper call frequency threshold;

(D) the parameter (40) runs by the elevator car and the parameter (43) operation of each door button during the absence of the parameter (39) being monitored and the ratio of door button operations per run for either door button exceeding a corresponding upper door button frequency threshold;

(E) the parameter (44) duration of operation of a button switch being monitored over a last given number of operations, and the average thereof exceeding a corresponding duration threshold;

(F) the parameter (45) total number of uses of a button switch being monitored and exceeding a corresponding button switch useful life threshold;

(G) the parameter (40) runs by the elevator car, the parameter (46) door open button use and the parameter (47) door reversals all being monitored and there being (i) no instances of parameter (46) use of door open button during a predetermined number of parameter (40) runs while (ii) the parameter (47) door reversals exceeds a door reversal threshold;

(H) the parameter (40) runs by the elevator car and the parameter (48) door close button use both being monitored and there being no instance of parameter (48) use of door close button for a predetermined threshold number of parameter (40) runs;

(I) generating a maintenance message to replace a related one of said call button lights in response to a corresponding one of the following conditions (K)–(M):

(J) the parameter (41) stops at each landing and the parameter (43) operation of each call button switch being monitored and the ratio of calls per stop at any landing exceeding a corresponding call button light frequency threshold;

(K) the parameter (44) duration of operation of a call button switch being monitored and exceeding a call button light duration threshold;

(L) the parameter (45) total number of uses of each call button switch being monitored and one of them exceeding a corresponding button light useful threshold.

10. A method of auditing the operation of an elevator system serving a plurality of landings and having (i) car guide rails and (ii) a car juxtapositioned with said rails by (iii) car rail guides, which method comprises:

(A) monitoring at every landing as each is served by the elevator system, over one or more measurement spans, parameters corresponding to steps (C) and (D) selected from (1) the position of the car door when a landing door lock switch opens and (2) the total distance that the elevator car has traveled;

(B) performing at least one of the following steps (C) and (D);

(C) determining the occurrence of at least one of (a) the variation in the parameter (1) position at any given landing exceeding a first position variation threshold, for a number of different landings which exceeds a first predetermined fraction of said landings, and (b) the parameter (2) total distance exceeding a total distance threshold, and in response thereto generating a maintenance message to adjust or replace the car rail guides;

(D) determining the occurrence of the variation in the parameter (1) position at any given landing exceeding a second position threshold, for a number of different landings which is less than a second predetermined fraction of said landings, and in response thereto generating a maintenance message to adjust the side-to-side clearance of said car guide rails at any said given landing.

* * * * *